United States Patent [19]

Strunc

[11] 4,214,310

[45] Jul. 22, 1980

[54] MANAGEMENT DATA SYSTEM FOR PRINT SORTER

[75] Inventor: Gerald R. Strunc, Maple Grove, Minn.

[73] Assignee: Pako Corporation, Minneapolis, Minn.

[21] Appl. No.: 949,694

[22] Filed: Oct. 10, 1978

[51] Int. Cl.[2] ..... G06M 3/06

[52] U.S. Cl. ..... 364/475; 235/92 PD; 355/13; 364/478; 364/900

[58] Field of Search ..... 364/900, 475, 525, 401–403, 364/471, 478; 235/92 SB, 92 PD, 92 PE, 92 EA; 355/13, 14, 16, 28, 29; 83/926 J

[56] References Cited

U.S. PATENT DOCUMENTS

| | | | |
|---|---|---|---|
| 3,454,336 | 7/1969 | Wick et al. | 355/29 |
| 3,718,807 | 2/1973 | Bracken et al. | 235/92 PD |
| 3,823,388 | 7/1974 | Chadima, Jr. et al. | 364/900 |
| 3,947,109 | 3/1976 | Kinder et al. | 355/29 |
| 4,123,649 | 10/1978 | Strunc | 235/92 PD |

*Primary Examiner*—Errol A. Krass
*Attorney, Agent, or Firm*—Kinney, Lange, Braddock, Westman and Fairbairn

[57] ABSTRACT

A management data system is used in conjunction with a photographic print cutting and sorting system. First and second storage means store two sets of data for each of a plurality of operators and printers. The two sets of data are independently resettable so that they reflect totals or percentages over two different time periods (for example, daily and monthly totals or percentages). A portable data retrieval device selects the particular operator or printer data from the two sets of data and displays operator totals, operator rates, printer totals or printer percentages based upon either the first or second set of data.

17 Claims, 4 Drawing Figures

MANAGEMENT DATA SYSTEM FOR PRINT SORTER

BACKGROUND OF THE INVENTION

1. Field of the Invention

The present invention relates to photographic processing equipment. In particular, the present invention is a management data system which is used in conjunction with a photographic paper cutter and photographic print sorter, and which maintains individual data for a plurality of operators of the paper cutter/sorter and for a plurality of photographic printers which supply photographic print paper to the paper cutter/sorter.

2. Description of the Prior Art

In commercial photographic processing operations, very high rates of processing need to be achieved and maintained in order to operate profitably. To expedite the photographic processing, orders containing film of similar type and size are spliced together for developing. As many as 500 to 1000 rolls of 12, 20, 24, and 36 exposure film may be spliced together for processing and printing purposes.

After developing, the photographic film contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of photographic print paper has been processed to produce prints, a photographic paper cutter cuts individual prints from the strip. The prints are then sorted by customer order, either manually or automatically, and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. Cut marks indicate the desired location of a cut between adjacent prints. End-of-order marks, which typically appear along the opposite edge of the print paper from the cut marks, indicate the end of a customer's order. The automatic paper cutter includes a sensor which senses the cut marks and causes the individual prints to be cut from the strip at desired locations. The separated prints are passed to an order packaging or grouping device which groups the prints in response to the end-of-order marks which are sensed by the automatic cutter.

The desire for higher rates of processing within commercial photographic processing operations has led to the development of extremely high speed automatic paper cutters. One example of such an automatic paper cutter is described in U.S. Pat. No. 4,128,887 entitled "Microprocessor Controlled Photographic Paper Cutter" by G. Strunc and F. Laciak, which is assigned to the same assignee as the present application. The automatic paper cutter described in this co-pending application is capable of cutting over 25,000 prints per hour (i.e. over seven prints per second).

Automatic print sorters have also been developed for use in conjunction with automatic paper cutters. Typically, the automatic print sorter sorts prints in an order into three categories: good prints, remake prints, and reject prints. A good print is a print which meets the quality standards of the photoprocessor and is saleable. A remake print is a nonsaleable print that can be reprinted with some combination of density and color corrections to become a saleable or good print. A reject print is a nonsaleable print which cannot be printed to become a saleable print.

An automatic print sorter typically receives signals from a remake/reject print sensor or sensors which senses remake print indicia and reject print indicia on the face of the remake and reject prints, respectively. These indicia are applied to the prints by the operator, who monitors the strip of print paper as it advances and the individual prints are cut from the strip. The automatic sorter includes means for directing prints along different paths depending upon whether a print is a good print, a remake print, or a reject print. This classification is done on the basis of the signals from the remake/reject sensor or sensors.

Despite the automatic operation of photographic paper cutters and print sorters, the amount of information available for use by management of the photoprocessing establishment has been relatively limited. One print sorter system which has a microcomputer control stores management information such as hours of operation by each operator, prints sorted by each operator, orders packed per operator, the number of prints per hour per operator, the number of orders per hour per operator, and the percentages of good prints, remake prints, and reject prints by printer. In this print sorter system, however, there is no differentiation between printer and operator in storage or display of the information. In other words, the system assumes that the same operator will cut prints from only one printer. If this is not the case, then either the operator totals and percentages or the printer percentages, or both, will be inaccurate.

SUMMARY OF THE INVENTION

The present invention is a management data system for use in conjunction with a photographic print cutting and sorting system. The management data system includes first and second storage means for storing two sets of data. The data which is in the form of various counts is stored independently for each of a plurality of photographic printers and for each of a plurality of operators. The particular printer or operator for which data is then being stored is designated by printer designating means and operator designating means. Digital processor means increments the appropriate counts stored in the first and second storage means for the designated printer and designated operator. Reset means selectively resets the first and second set of data so that the first and second sets of data can contain totals of the same items over different time periods. Data retrieval means retrieves and displays data based upon the counts stored in the first and second storage means.

The management data system of the present invention, therefore, permits management to monitor independently both operator and printer performance on both a short term (e.g. daily) and a long term (e.g. monthly) basis. The short term data can reveal problems with a particular operator or a particular printer which is supplying print paper to the cutter. The longer term data, on the other hand, provides meaningful information as to the profitability of various aspects of the processing operation.

In one preferred embodiment the first and second sets of data include, for each of a plurality of photographic printers: first and second good print counts, first and second remake print counts, first and second reject print counts, first and second total print counts, first and second good order counts, first and second remake order counts, first and second reject order counts, and first and second total order counts. In addition, the first and second sets of data further include, for each of the plurality of operators: first and second total print cut counts, first and second total orders processed counts, and first and second hours operated counts. From these counts, operator totals, operator rates, printer totals, and printer percentages can be retrieved by the data retrieval means. The operator totals include total number of prints cut, orders processed, and hours operated by each of the operators. The operator rates include prints per order, prints per hour, and orders per hour for each of the operators. The printer totals include the total number of good, remake, reject and total prints, and good, remake, reject and total orders. The printer percentages include the percentages of good, remake, and reject prints, and the percentages of good, remake and reject orders for each printer.

DETAILED DESCRIPTION OF THE PREFERRED EMBODIMENTS

Figure 1:
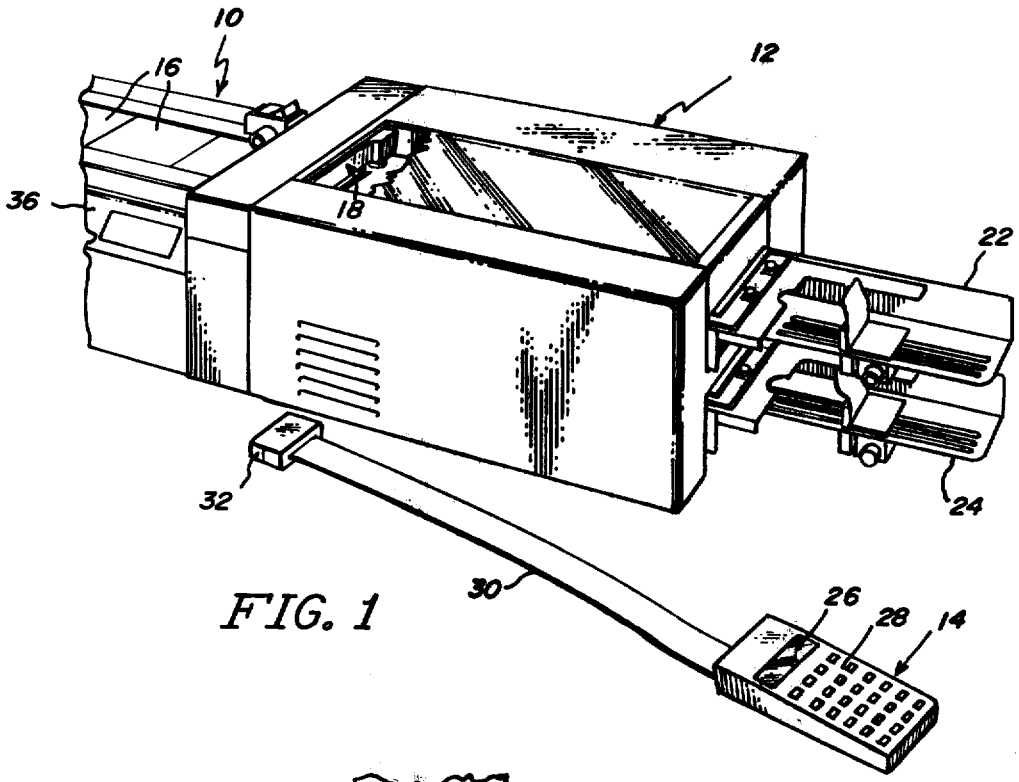
FIG. 1 shows a perspective view of a photographic print cutting and sorting system which utilizes the management data system of the present invention.

FIG. 1 shows a photographic print cutting and sorting system which includes a photographic print cutter 10, a print sorter 12, and a portable data retrieval device 14. In one successful embodiment of the present invention, photographic print cutter 10 is an automatic photographic paper cutter like that described in the previously-mentioned U.S. Pat. No. 4,128,887 entitled "Microprocessor Controlled Photographic Paper Cutter" by G. Strunc and F. Laciak, which is assigned to the same assignee as the present application.

Photographic prints are cut from strip 16 by knife assembly 18 of print cutter 10. The cut prints are sorted by print sorter 12 into good, remake, and reject prints. This sorting is done on the basis of remake and reject indicia which are applied to the face of remake and reject prints, respectively, by the operator of the cutter/sorter. The indicia are sensed by remake/reject sensor 20, which is located on print cutter 10 near knife assembly 18.

Those prints which have neither a remake indicium or a reject indicium are stacked by sorter 12 into a stack of prints on good print tray 22. Remake prints are driven along a different path by sorter 12 and are stacked on remake print tray 24. Reject prints are driven along still a third path and are either driven out the bottom of sorter 12 and into a waste basket or the like, or are driven and accumulated on a third print tray (not shown). In one embodiment, the apparatus for directing the good, remake, and reject prints along different paths is generally similar to that shown in U.S. Pat. No. 4,114,349 entitled "Automatic Sorting, Conveying, and Packing Mechanism for Photographic Prints" by G. Jensen, L. Larson, and R. Diesch which is assigned to the same assignee as the present application.

In the apparatus shown in FIG. 1, the operator must remove the good and remake prints accumulated in trays 22 and 24, respectively, at the end of each order. The system is then restarted and the prints of the next order are sorted.

Portable management data retrieval device 14 shown in FIG. 1 includes a display 26 and a keyboard 28. Portable management data retrieval device 14 is connected electrically to the electrical system of the cutting and sorting system by connecting cable 30. Plug 32 at the end of cable 30 is received by a receptacle 34 shown in FIG. 4 on the back side of print cutter 10. Portable management data retrieval device 14, therefore, may be attached and detached from the print cutting and sorting system at will. Generally retrieval device 14 is in the possession of a supervisor or manager of the photoprocessing operation, who periodically connects retrieval device 14 to each of a plurality of similar print cutting and sorting systems to retrieve data from each of those systems. The management data is actually stored in memory within the cutting and sorting system, and retrieval device 14 merely allows the manager to retrieve the information stored in memory and to reset the totals stored within the memory.

In one preferred embodiment of the present invention, data is maintained for four different operators (designated numbers "1" through "4") and seven different printers (designated numbers "1" through "7"). In addition, the same data is maintained for all operators combined and for all printers combined. The data is stored in two separate sets, designated "A" and "C" for each of the operators and each of the printers, as well as for the combination of all the operators and the combination of all the printers. The data of the two sets is independently resettable, so that the "A" set of data and the "C" set of data can contain totals of the same items over different time periods. For example, one set of data contains daily totals, while the other set of data contains monthly totals. The short term (daily) data can reveal problems with a particular operator or a particular printer, while the longer term (monthly) data provides meaningful information which can be used to determine profitability of various aspects of the photoprocessing operation.

The operator data (both set "A" and set "C") includes the following totals: (a) prints cut, (b) orders processed, and (c) hours operated for each of the four operators and for the combination of the four operators.

The printer data includes the following printer totals: (a) good prints, (b) remake prints, (c) reject prints, and (d) total prints, (e) good orders, (f) remake orders, (g) reject orders, and (h) total orders. These totals are maintained for each of the seven printers and for the combination of all printers, and are independently maintained in both sets of data, "A" and "C".

Figure 2:
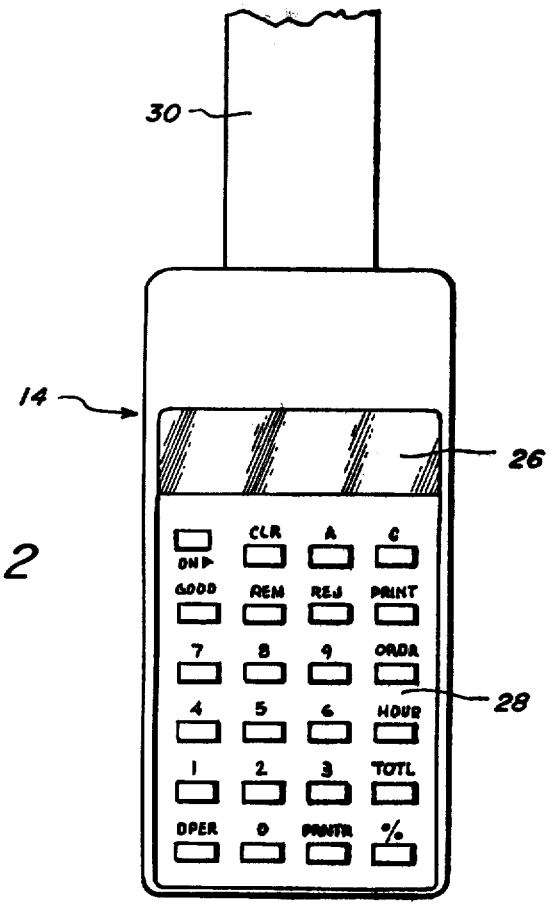
FIG. 2 is a top view of the portable management data retrieval device shown in FIG. 1.

FIG. 2 shows display 26 and keyboard 28 of a preferred embodiment of portable retrieval device 14. As shown in FIG. 2, display 26 is an 8-digit display which displays selected operator totals, operator rates, printer totals, or printer percentages selected by the manager through keyboard 28. The information displayed on display 28 is supplied from the electrical circuitry within the print cutting and sorting system, and is based upon the operator and printer totals stored in memory.

As shown in FIG. 2, the keyboard 28 is a 23 key keyboard together with a sliding on/off switch. The keys are arranged in four columns and six rows.

In the preferred embodiment shown in FIG. 2, retrieval device 14 permits retrieval of operator totals, operator rates, printer totals, and printer percentages. The operator totals (for each of four operators and the combination of all four operators) includes: total number of prints cut, total number of order processed, and total number of hours operated.

The operator rates (for each operator and for all operators combined) includes: prints per order, prints per hour, and orders per hour.

The printer totals (for each of seven printers and all printers combined) include: number of good, remake, reject, and total prints, and number of good, remake, reject and total orders.

The printer percentages (for each printer and all printers combined) include: the percentages of good, remake, and reject prints and the percentages of good, remake, and reject orders.

To retrieve data, plug 32 is connected to the receptacle at the back of print cutter 10. The on/off switch at the upper left hand corner of keyboard 28 is then moved to the right to the ON position. A message, such as "PS-305", is displayed to indicate that the display 26 is functional.

Three key depressions are required to select the operator or printer whose data is to be displayed. The first key depression is either the OPER or the PRNTR key. The second key depression is one of the keys labeled 1–7 or the TOTL. The third key depression is either key "A" or "C". In other words, the first key depression selects whether operator data or printer data will be selected. The second key depression selects which of the particular operators or particular printers is selected or whether the combined data for all operators or all printers is desired. The third key depression selects either the data from the first set "A" or the second set "C".

After the third key depression, the selection which has been made is displayed on display 26. Operator/-printer selection may be changed at any time after an operation has been completed. Until the operator/-printer selection is changed, each subsequent request for data involves data stored for the particular operator or printer selected, and is from either set "A" or set "C", depending upon which data set has been selected.

Two key depressions are required to display data. In the case of operator data, the operator totals involve depressing either the PRINT, ORDR, or HOUR key, followed by the TOTL key. In other words, to obtain the total number of prints cut for a particular operator, the PRINT key is first pushed and then the TOTL key is pushed. Similarly, the orders total is obtained by first depressing the ORDR key and then the TOTL key. The hours total is obtained by depressing first the HOUR key and then the TOTL key.

The operator rates are also obtained by depressing just two keys. Prints per order is obtained by depressing first the PRINT key and then the ORDR key; prints per hour by depressing the PRINT key and then the HOUR key, and orders per hour by depressing the ORDR key and then the HOUR key.

In the case of the printer data, the operator must select whether printer totals or printer percentages will be retrieved. This is done by pressing the % key if printer percentages are desired. If the % key is not depressed prior to requesting print data, the system automatically displays printer totals.

To retrieve printer totals, the manager first depresses either the GOOD, REM, REJ, or TOTL keys and then the PRINT key in order to obtain the total number of good, remake, reject, or total prints, respectively. Similarly, good, remake, reject and total orders are retrieved by first depressing the GOOD, REM, REJ, or TOTL key, followed by the ORDR key.

To obtain printer percentages, the manager depresses the % key after the three key depressions which have selected a particular printer and data set have been made. To obtain the percentages of good, remake, or reject prints, the manager depresses the GOOD, REM, or REJ keys followed by the PRINT key. Similarly, to obtain the percentages of good, remake, or reject orders, the manager first depresses the GOOD, REM or REJ key followed by the ORDR key.

Keyboard 28 also includes means by which data from either the "A" set of data or the "C" set of data may be cleared. The data clear function is performed by first depressing the CLR key. The operator/printer selection is then made by either depressing the OPER or PRNTR key, followed by keys 1–7 or TOTL, followed by either key "A" or "C". The operator/printer selection which has been made then flashes on display 26 to indicate readiness for clearing. By depressing the CLR key a second time, the manager zeros all totals stored for that particular operator/printer in either the "A" or "C" set of data, depending upon which data set has been selected. Display 26 goes blank to indicate the completion of the clear operation. While the display is flashing, the depression of any key other than the CLR key prevents the clearing operation from taking place and also causes an "ERROR" message to be displayed.

Depression of the wrong key in any of the above described sequences in either operator/printer selection, data display, or data clear, causes the word "ERROR" to be displayed. If this occurs, the sequence must be restarted. In the preferred embodiment of the present invention, it is not necessary to depress the CLR key after an error message has been displayed.

When the manager has completed the retrieval process, he moves the on/off switch to the left, away from the ON position. Display 26 then goes blank. At that point, plug 32 may be disconnected from paper cutter 10.

Figure 3:
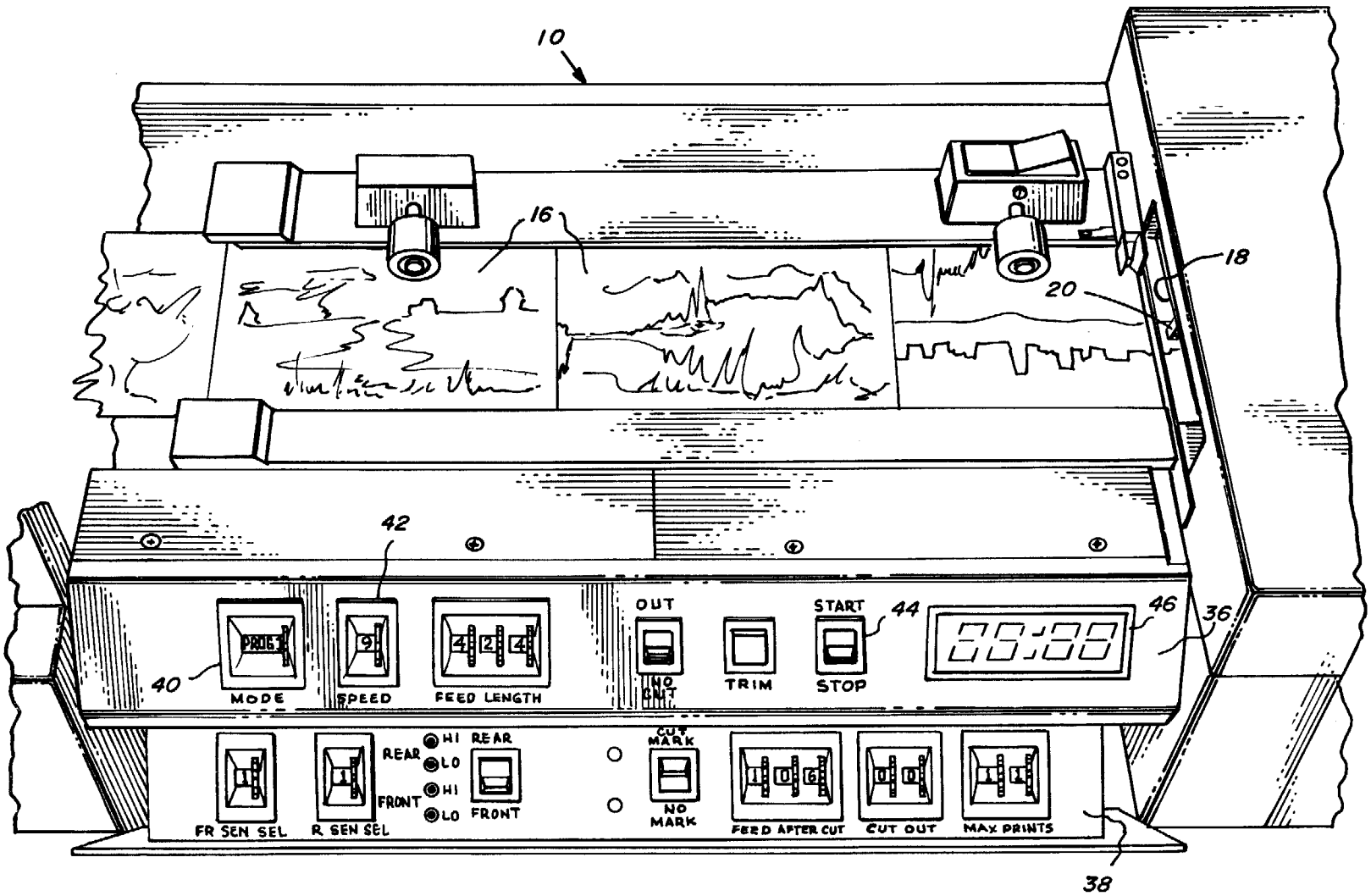
FIG. 3 shows the main and auxiliary control panel of the photographic print cutter shown in FIG. 1.

FIG. 3 shows the main control panel 36 and the auxiliary control panel 38 of paper cutter 10. Main control panel 36 provides the means by which a particular printer and operator is designed or assigned when prints are being cut and sorted. Although a number of switches are shown on main and auxiliary control panels 36 and 38, the switches which are used in the operator and printer assignment function are mode switch 40, speed switch 42, start/stop switch 44, together with display 46.

Prior to beginning a new shift or a new day of operation, mode switch 40 is turned to the "PROG 1" mode, and speed select switch 42 is moved to "O". Start switch 44 is then moved to the start position and released. The system then displays, on 4-digit display 46, the current printer assignment and the current operator assignment. In a preferred embodiment, the left hand digit of display 46 displays the current printer assignment, while the right hand digit displays the current operator assignment.

If a change in printer assignment is desired, speed switch 42 is dialed to the desired printer number (1 through 7) and start/stop switch 44 is again moved to the start position and released. The number then contained in speed switch 42 is transferred to the left hand digit of display 46 and becomes the current printer assignment. If the same operator is still running the system, the mode switch 40 is then moved back to the "RUN" position and normal operation of the system is again commenced.

On the other hand, if a new operator assignment is desired, the speed select switch 42 is again moved, this time to the desired operator number, and start/stop switch 44 is again moved to the start position and released. The number displayed on the right hand digit of display 46 is the number then contained in speed select switch 42, and this number becomes the current operator assignment.

Continuing change of the operator and printer assignments can be made by continually changing the speed switch 42 and moving the start/stop switch 44 to the start position. Ordinarily, however, only a change in printer assignment, or only a change in operator assignment will be made at any particular time. The assignment of printer and operator numbers continues to alternate back and forth until mode select switch 40 is moved out of the PROG 1 position.

Figure 4:
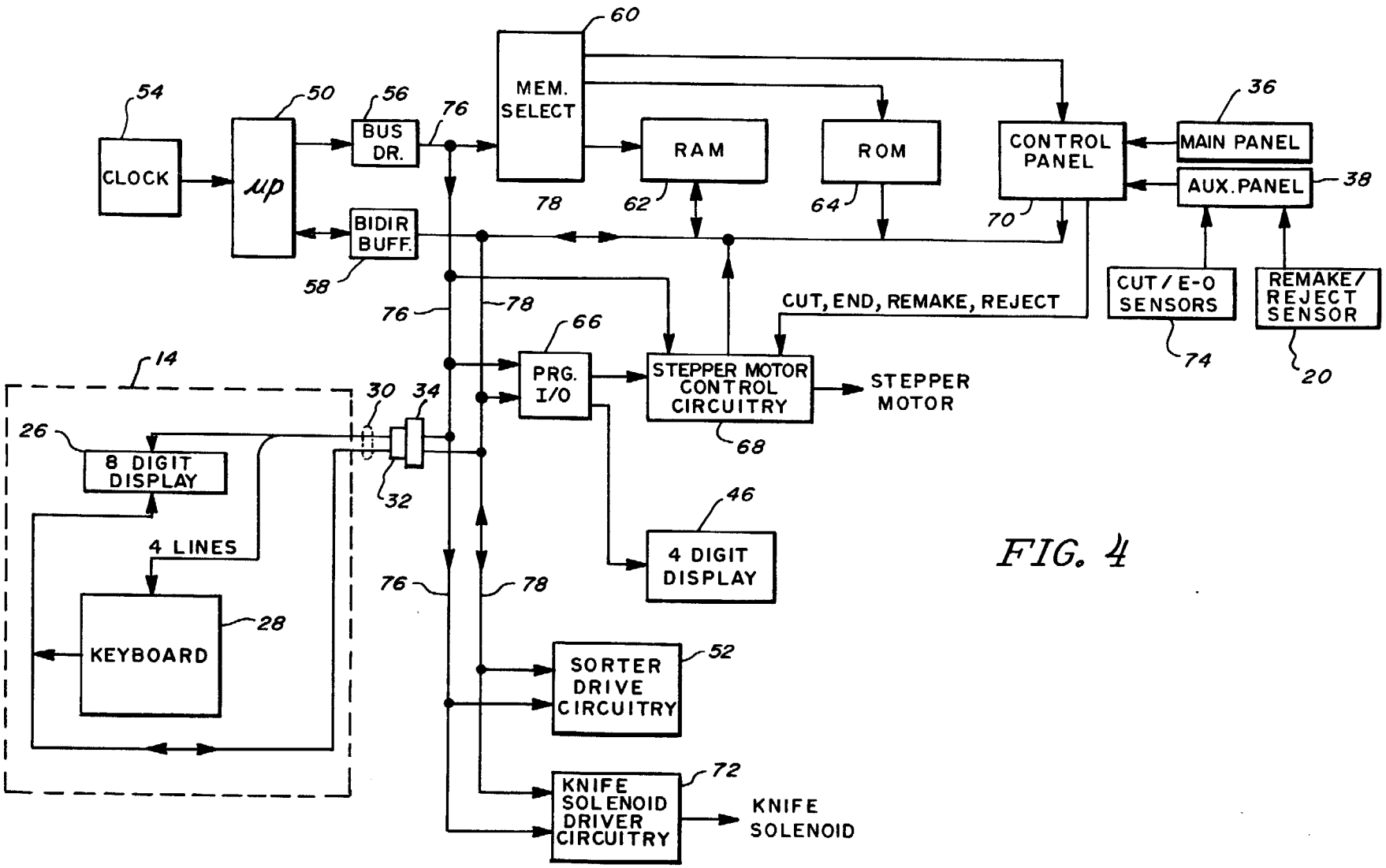
FIG. 4 is an electrical block diagram of a photographic print cutting and sorting system which includes the management data system of the present invention.

FIG. 4 is an electrical block diagram of a photographic print cutting and sorting system which includes the management data system of the present invention. In this preferred embodiment, the circuitry associated with the paper curter has been described in detail in the previously mentioned U.S. Pat. No. 4,128,887. The present invention utilizes the same microprocessor 50 which is used to control the various functions of the paper cutter to maintain the update the various printer and operator totals and to calculate the operator rates and printer percentages. Microprocessor 50 controls display 26 in response to input signals from keyboard 28 of data retrieval device 14. In addition to the functions of the paper cutter and the management data system, microprocessor 50 also controls sorter drive circuitry 52.

The system of FIG. 4 includes microprocessor 50, sorter drive circuitry 52, clock 54, bus driver 56, bidirectional buffer 58, memory select circuitry 60, random access memory (RAM) 62, read-only memory (ROM) 64, programmable input/output (I/O) device 66, stepper motor control circuitry 68, control panel logic 70, and knife solenoid driver circuitry 72. Signals are received from remake/reject sensor 20, cut/end-of-order sensors 74 and keyboard 28 of retrieval device 14. 8-digit display 26 of retrieval device 14 and 4-digit display 46 of control panel 36 are controlled by the circuitry.

In one preferred embodiment, microprocessor 50 is an 8-bit microprocessor such as the Intel 8080A. Clock circuit 54 supplied clock signals together with some other related signals to microprocessor 50. Bus driver 56 receives outputs from microprocessor 50 and drives various lines of address bus 76. Memory select circuit 60 receives the signals from address bus 76 and addresses selected locations of RAM 62 and ROM 64. In addition, memory select circuitry 60 may address control panel logic 70 to interrogate various switches of main and auxiliary control panels 36 and 38. The system shown in FIG. 4, the switches of main and auxiliary panels 36 and 38 are addressed in the same manner as a memory location. Data to and from RAM 62, ROM 64, and control panel logic 70 are supplied over data bus 78. Bidirectional buffer 58 interconnects microprocessor 50 with data bus 78.

Memory select circuitry 60 also connects to display 26 and keyboard 28 of retrieval device 14. When addressed, display 26 receives data from data bus 78, while keyboard 28 supplies data to data bus 78 when it is addressed.

Programmable I/O device 66 is also connected to address bus 76 and data bus 78. Signals from microprocessor 50 is used by programmable I/O device 66 to control operation of the stepper motor through stepper motor control circuitry 68. In addition, programmable I/O device 66 provides control signals for 4-digit display 46 in response to signals from microprocessor 50.

Knife solenoid driver circuitry 72 receives signals from microprocessor 50 over address bus 76 and data bus 78. The solenoid of the knife clutch is actuated by knife solenoid driver circuitry 72 each time a print is cut.

The signals from remake/reject sensor 20 and from cut and end-of-order sensor 74 are routed through auxiliary panel 38 and control panel logic 70 to a multiplexer (not shown) within stepper motor control circuitry 68. Microprocessor 50 monitors the status of the sensor signals by addressing this multiplexer. It is from these signals that the microprocessor determines when to energize the solenoid of the knife clutch and when to terminate the paper feed for a particular paper feed and cut cycle.

Based upon the signals from the remake/reject sensor 20, microprocessor 50 controls the sorter drive circuitry 52. The prints are directed into the proper collecting tray dependent upon whether a remake indicium has been sensed, a reject indicium has been sensed, or no indicia (indicating a good print) have been sensed.

Because the microprocessor 50 controls both the cutting and the sorting of each print, and receives signals indicating the end of each order, microprocessor 50 is used in the present invention to process and maintain a large amount of useful management data. In the preferred embodiment shown in FIG. 4, this data is stored in selected memory locations in RAM 62. Because of the increased memory requirements of the management data system of the present invention, both RAM 62, and ROM 64 have greater memory capacity than is required when only a paper cutter is controlled, as in the previously mentioned application Ser. No. 838,064.

Depending upon which operator is selected, and which printer is selected, microprocessor 50 increments various counts stored in RAM 62. These counts include, for each of the photographic priners and for the combination of all printers (a) first and second good print counts, (b) first and second remake print counts, (c) first and second reject print counts, (d) first and second total print counts, (e) first and second good order counts, (f) first and second remake order counts, (g) first and second reject order counts, (h) first and second total order counts. The counts stored in RAM 62 also include, for each of the operations, and the combination of all operators: (i) first and second total print counts, (j) first and second total orders processed counts, and (k) first and second hours operated counts.

The "first" counts form data set "A", and the "second" counts form data set "B". Because the counts can be cleared independently, the first counts (i.e. the "A" data) can reflect the totals over a first time period, while the second counts (i.e. the "C" data) reflect the same items taken over a second time period.

For the purposes of an example, assume that operator #1 and printer #5 have been designated by the operator through mode select switch 40 and speed select switch 42. Microprocessor 50 increments the counts stored in RAM 62 for the designated printer (#5) and the designated operator (#1), as well as the counts for the combination of all printers and the combination of all operators.

When a print is cut for which no remake or reject indicia is sensed (i.e., a "good print"), microprocessor 50 causes a sorter drive circuitry 52 to drive the good print to the good print tray 22 shown in FIG. 1. Microprocessor 50 increments the first and second good print counts for printer #5, as well as the first and second good print counts and total print counts for the combination of all printers. In addition, microprocessor 50 increments the first and second total prints cut counts for operator #1 and for the combination of all operators.

When a remake indicium on a print is sensed by remake/reject sensor 20, microprocessor 50 causes sorter drive circuitry 52 to divert the remake print into another path and onto remake print tray 24 of FIG. 1. Microprocessor 50 increments the first and second remake print counts and total print counts for printer #5 and for the combination of all printers, and once again increments the first and second total print cut counts for operation #1 and for the combination of all operators. In addition, when a remake print is encountered during an order, microprocessor 50 increments the first and second remake order counts for printer #5 and for the combination of all printers. These remake order counts are only incremented once in any particular order. In other words, the remake order counts represent the number of orders which contain at least one remake print, but the counts do not indicate how many remake prints were contained in any particular order.

When a reject indicium is sensed by remake/reject sensor 20, microprocessor 50 causes sorter drive circuitry 52 to drive the reject print either out the bottom of sorter 12 into a waste basket or onto a third tray for reject prints. The first and second reject print counts and total print counts for printer #5 are incremented, as are the first and second reject print counts and total print counts for the combination of all printers. The first and second total print cut counts for operator #1 and for the combination of all operators are also incremented.

When a reject print is encountered, microprocessor 50 also increments the first and second reject order counts for printer #5 and for all printers. As in the case of the remake order counts, these counts are incremented only once per order which contains at least one reject print.

At the end of each order, an end-of-order indicia is sensed by cut/end-of-order sensor 74. Microprocessor 50 increments the first and second total order counts for #5 and for all printers combined and increments the first and second total orders processed counts for operator #1 and all operators combined. In addition, if the order contained only good prints (i.e. neither a remake nor a reject print was encountered during the order), microprocessor 50 increments first and second good order counts for printer #5 and for all printers combined.

During the entire operation of the print cutting and sorting system, the microprocessor 50 also is incrementing the first and second hours operated counts for the designated operator and all operators combined. In one preferred embodiment, microprocessor 50 increments the hours operated counts every 1/4096 hours.

When the manager wishes to retrieve management data, data retrieval device 14 is connected to the system and the desired data is requested through keyboard 28 as described previously. Microprocessor 50 addresses one of the four columns of keyboard 28 through the four address lines which are connected to keyboard 28. It reads out the button or key selected from that column, if any, through data bus 78. By addressing each of the four columns, microprocessor 50 receives the instructions from keyboard 28 as to the information which is to be displayed. Microprocessor 50 then sequentially addresses each of the eight digits of display 26 and supplies seven-segment display input signals to the display drivers through data bus 78.

In the case of the operator rates and the printer percentages, microprocessor 50 retrieves the information from RAM 54, calculates the rate or percentage requested, and then supplies signals which cause display 26 to display that rate or percentage. In the case of the operator totals or printer totals, the counts contained in random access memory 54 are merely converted by microprocessor 50 to the appropriate drive signals for display 26.

When the manager requests a data clear operation through keyboard 28, microprocessor 50 clears the particular count or counts selected by the clear operation. As discussed previously, the ability to clear independently the individual counts permits the two sets of data ("A" and "C") to be maintained for different time periods, such as daily or monthly periods.

It should be noted that the total of the good, remake and reject orders may exceed the total number of orders which were processed if there are orders which contained both remake and reject prints. This is because a particular order is designated as both a remake and a reject order if it contains both a remake print and a reject print. The total of the good, remake, and reject order percentages, therefore, may exceed 100 percent. The maintaining of totals and percentages of good, remake, and reject orders is highly advantageous, since it provides an indication of how many orders required special handling due to remake or reject prints. This information has not been available in the prior art systems.

Tables 1 and 2 show assembler listings for microprocessor 50 which were used in one successful embodiment of the present invention. The listings in Table 1 are entirely concerned with the management data system. The listings of Tables 2 and a small portion of the total listings of the print cutter control which relate directly to the incrementing of the counts. The remaining listings for the print cutter control are not included because they do not form a part of the invention. Reference may be made to the previously-mentioned copending patent application Ser. No. 838,064 for examples of complete listings for the print cutter related functions.

In conclusion, the present invention is a management data system which provides far more information than has previously been available with photographic print cutting and sorting systems. Individual data for each of a plurality of operators and each of a plurality of printors, as well as combined data for all operators and all printers, is maintained. The data is maintained in the form of two sets of counts ("A" and "C") which permits both daily and monthly data to be maintained. The two sets of data are independently resettable so that any time period selected by management can be accommodated for these two sets of data.

Retrieval of the data is provided through a portable data retrieval device. This assures security of the management data, since the operator of the system cannot tamper with the counts or clear the counts maintained in memory. Only the person in possession of the portable data retrieval device (usually the manager of the photoprocessing operation) can clear counts stored in memory. In addition, a single portable data retrieval device can be used with similar cutting and sorting systems, thereby reducing duplication of equipment.

Although the present invention has been described with reference to preferred embodiments, workers skilled in the art will recognize that changes may be made in form and detail without departing from the spirit and scope of the invention.

TABLE 1

```
$LEDIT
$MACROFILE
$PRINT(:LP:)
;
;ORDER.MD
;
        EXTRN   BCDBI,BIBCD,DELAY,NMOT4
        EXTRN   STOPM,SWSTM,WORK
        PUBLIC  ASPASS,ASSIGN,BCDDAT,DIGITD,GOORD,GOPPTR,KB1
        PUBLIC  KBIN,MESL,MESTES,MDCLR,DANUM,ORDPTR,PATPTR
        PUBLIC  REMORD,SHOW,TESTKB,TIMETP,TIMLOD,[illegible]
;
;
$INCLUDE(:F1:MACRO)
;
;ROUTINE:MACRO
;
;THIS MACRO WILL ADD FIELDW TO THE POINTER BASE IN THE HL
;REGISTER. THE A REGISTER CONTAINS THE NUMBER OF TIMES THIS
;IS DONE.
;
;
CALPTR  MACRO   FIELDW,DATAB,PTR[illegible]  ;CALCULATE POINTER
        LXI     D,FIELDW        ;FIELD WIDTH TO BC
        LXI     H,DATAB         ;DATA BASE
        LXI     D,PTR   ;POINTER ADDRESS
        IF      COND1
        ANA     A
        JZ      $+3     ;IF 0 DON'T CHANGE
        ENDIF
        DAD     B       ;ADD FIELD WIDTH
        DCR     A       ;DECREASE LOOP COUNTER
        JNZ     $-2
        ENDM
;
;THIS MACRO CAUSES THE KEYBOARD TO BE
;TESTED FOR AN ENTRY AND RETURNS TO MAIN
;PROGRAM IF OFF.
;
READKB  MACRO
        CALL    KBIN    ;READ KEYBOARD
        RC              ;GO BACK IF OFF
        ENDM
;
;THIS MACRO WILL SET UP THE REGISTERS FOR UPDATING
;THE PRINTER OR OPERATOR TOTALS
;
TOTUPM  MACRO   NUM,SUM,FIELDW,DATAB
        MVI     B,NUM   ;NUMBER OF FIELDS
        MVI     C,SUM   ;QUANTITY OF SUMS IN EACH FIELD
        LXI     D,FIELDW        ;FIELDWIDTH(OFFSET)
        LXI     H,DATAB ;TOTAL SUM ADDRESS
```

```
        CALL    TCTUPD
        ENDM
;
$INCLUDE(:F1:EQUM)
;
;ROUTINE:EQUM
;
;THIS ROUTINE CONTAINS THE EQUATES NECESSARY TO THE
;MANAGEMENT DATA OPTION.  THE SINGLE ALPHANUMERIC
;CHARACTERS PRECEEDED BY A "D" DEFINE THE OUTPUT
;NECESSARY TO DRIVE A 7 SEGMENT DISPLAY FOR THAT
;CHARACTER.  BITS 0 THRU 6 CORRESPOND TO SEGMENTS
;A THRU G RESPECTIVELY.  BIT 7 CORRESPONDS TO THE
;DECIMAL POINT.
;
D0      EQU     0C0H
D1      EQU     0F9H
D2      EQU     0A4H
D3      EQU     0B0H
D4      EQU     99H
D5      EQU     92H
D6      EQU     82H
D7      EQU     0F8H
D8      EQU     80H
D9      EQU     98H
DA      EQU     88H
DC      EQU     0C6H
DE      EQU     86H
DL      EQU     0C7H
DO      EQU     0A3H
DP      EQU     8CH
DR      EQU     0AFH
DT      EQU     00H     ;TEST PATTERN
DZ      EQU     92H     ;"S"
DDP     EQU     7FH     ;DECIMAL POINT
DB      EQU     0FFH    ;SPACE
;
;KEYBOARD EQUATES
;
K0      EQU     38H     ;"0" KEY
K1      EQU     30H     ;"1" KEY
K2      EQU     28H     ;"2" KEY
K3      EQU     20H     ;"3" KEY
K4      EQU     18H     ;"4" KEY
K5      EQU     10H     ;"5" KEY
K6      EQU     08H     ;"6" KEY
K7      EQU     00H     ;"7" KEY
K8      EQU     39H     ;"8" KEY
K9      EQU     31H     ;"9" KEY
KA      EQU     3AH     ;"A" KEY
KC      EQU     2AH     ;"C" KEY
KCLR    EQU     32H     ;"CLEAR" KEY
KGOOD   EQU     03H     ;"GOOD" KEY
KHOUR   EQU     33H     ;"HOUR" KEY
KOPER   EQU     1AH     ;"OPERATOR" KEY
KORDR   EQU     2BH     ;"ORDER" KEY
KPRNT   EQU     23H     ;"PRINTS" KEY
KPRTR   EQU     02H     ;"PRINTER" KEY
KREM    EQU     10H     ;"REMAKE" KEY
KREJ    EQU     13H     ;"REJECT" KEY
KTOTL   EQU     36H     ;"TOTAL" KEY
KPRCT   EQU     22H     ;"PER CENT" KEY
COND1   SET     0
;
DISON   EQU     0A5H    ;KEYBOARD/DISPLAY ON (OUTPUT)
KDON    EQU     0A8H    ;BIT 7 LO FOR KEYBOARD/DISPLAY ON (INPUT)
```

```
KBRDY    EQU     0A9H     ;BIT 7 LO FOR KEYBOARD DATA READY (INPUT)
DISOF    EQU     0ADH     ;KEYBOARD/DISPLAY OFF (OUTPUT)
;
KDDATI   EQU     0DAH     ;KEYBOARD/DISPLAY DATA (INPUT)
KDDATO   EQU     0DAH     ;KEYBOARD/DISPLAY DATA (OUTPUT)
KDSTA    EQU     0DBH     ;KEYBOARD/DISPLAY STATUS (INPUT)
KDCOM    EQU     0DBH     ;KEYBOARD/DISPLAY COMMAND (OUTPUT)
;
RJECT    EQU     0F6H     ;BIT 7 LO FOR REJECT THIS PRINT (INPUT)
;
SPDSL    EQU     1005H    ;4LSD = MOTOR SPEED SWITCH (INPUT)
;
$INCLUDE(:F1:KB1)
;
;ROUTINE:KB1
;
;THIS ROUTINE IS THE MAIN PROGRAM FLOW WHEN THE
;KEYBOARD IS ON.  IT MAKES THE NECESSARY CALLS
;TO PROVIDE THE DATA SPECIFIED BY THE KEYBOARD.
;
;INPUTS:   NONE
;
;OUTPUTS:  CARRY FLAG IS SET
;
;DESTROYS: ALL
;
;
        ORG     1800H
KB1:                     ;KEYBOARD 1
        MVI     A,10H    ;COMMAND FOR 8 CHARACTER
                         ;DISPLAY RIGHT ENTRY &
                         ;ENCODED 2 KEY ROLLOVER
        OUT     KDCOM    ;COMMAND TO KEYB/DISPY
        XRA     A        ;A=0
        STA     MDCLR    ;CLEAR
        LXI     H,MESON  ;SIGN ON MESSAGE LOCATION
KB2:
        CALL    MESL     ;DISPLAY MESSAGE
        TOTUPM  4,(O2DATA-O1DATA)/3,O2DATA-O1DATA,OTDATA
+       MVI     B,4      ;NUMBER OF FIELDS
+       MVI     C,(O2DATA-O1DATA)/3      ;QUANTITY OF SUMS IN EACH FIELD
+       LXI     D,O2DATA-O1DATA ;FIELDWIDTH(OFFSET)
+       LXI     H,OTDATA         ;TOTAL SUM ADDRESS
+       CALL    TOTUPD
        TOTUPM  7,(P2DATA-P1DATA)/3,P2DATA-P1DATA,PTDATA
        MVI     B,7      ;NUMBER OF FIELDS
        MVI     C,(P2DATA-P1DATA)/3      ;QUANTITY OF SUMS IN EACH FIELD
        LXI     D,P2DATA-P1DATA ;FIELDWIDTH(OFFSET)
        LXI     H,PTDATA         ;TOTAL SUM ADDRESS
        CALL    TOTUPD
KB3:
        CALL    KBIN     ;ANY KEYS DEPRESSED?
        RC               ;CARRY SET IF OFF
        MOV     B,A      ;SAVE DATA
        ANI     3        ;MASK OFF UPPER 5 BITS
        CPI     3        ;COLUMN 3 SELECTED?
        JZ      COL3CK
        CPI     2        ;COLUMN 2 SELECTED?
        JZ      COL2CK
;
$INCLUDE(:F1:ERROR)
;
;ROUTINE:ERROR
;
;THIS ROUTINE WILL SET THE HL MEMORY POINTER TO THE
;BEGINNING OF THE ERROR MESSAGE. ALL MD DATA FLAGS
```

```
;WILL BE CLEARED & CONTROL WILL BE RETURNED TO THE
;START TO DISPLAY THE MESSAGE & LOOK FOR NEW KEYED DATA.
;
;OUTPUTS: HL - POINTS TO ERROR MESSAGE
;
;DESTROYS: - A,F,H,L
;
;
ERROR:
        XRA     A           ;A=0
        STA     MDCLR       ;RESET MGMT. DATA CLEAR
        LXI     H,MESERR
        JMP     KB2
;
$INCLUDE(:F1:COL2CK)
;
;ROUTINE:COL9CK
;
;THIS ROUTINE WILL PERFORM THE FUNCTIONS SELECTED BY
;COLUMN 2 KEYS OF THE DATA ENTRY KEYBOARD. THESE KEYS
;SET THE PERCENT FLAG AND BEGIN THE SEQUENCE TO CLEAR
;DATA AND TO SELECT THE PRINTER OR OPERATOR. AN INCORRECT
;ENTRY WILL DISPLAY AN "ERROR" MESSAGE AND CAUSE CONTROL
;TO LEAVE THIS ROUTINE.
;
;INPUTS:   A-DATA FROM KEYBOARD
;
;DESTROYS: ALL
;
COL2CK:                     ;COLUMN 2 CHECK
        MOV     A,B         ;KEYBOARD DATA TO ACCUMULATOR
        CPI     KOPER
        JZ      OPRSEL      ;IF OPERATOR MAKE ASSIGNMENT
        CPI     KPRTR
        JZ      PNRSEL      ;IF PRINTER MAKE ASSIGNMENT
        LDA     MDCLR
        ANA     A
        JM      ERROR       ;IF CLEAR SET,GO TO ERROR
        MOV     A,B         ;KEYBOARD DATA TO ACCUMULATOR
        CPI     KCLR
        JNZ     $+14        ;IF NOT CLEAR JUMP
        MVI     A,80H
        STA     MDCLR       ;SET CLEAR FLAG
        CALL    DISPK       ;BLANK DISPLAY
        JMP     KB3
        LDA     MESSTA
        ANA     A
        JZ      ERROR       ;ZERO IF NO SELECTION MADE
        MOV     A,B         ;KEYBOARD DATA
        CPI     KPRCT
        JNZ     ERROR       ;OTHER KEYS NOT VALID NOW
        LDA     MDOPER
        ANA     A
        JM      ERROR       ;NO % DATA FOR OPERATOR
        MVI     A,80H
        STA     MDPRCT
        CALL    DISSTA      ;SHOW CURRENT SELECTION
        JMP     KB3
OPRSEL:                     ;OPERATOR SELECT
        MVI     A,80H
        JMP     $+4         ;SKIP NEXT INSTRUCTION
PNRSEL:                     ;PRINTER SELECT
        XRA     A           ;A=0
        STA     MDOPER      ;STORE OPERATOR STATUS
        MOV     C,A         ;SAVE STATUS
        XRA     A           ;A=0
```

```
        STA     MDCTOT  ;RESET C TOTAL STATUS
        CALL    DISPK   ;BLANK DISPLAY
        CALL    KBIN
        RC              ;RETURN IF KEYBOARD OFF
        MOV     B,A     ;SAVE DATA
        ANI     3       ;MASK OFF UPPER 5 BITS
        MOV     A,B     ;KEYBOARD DATA TO ACCUMULATOR
        JZ      COSEL   ;KEY 0-7 SELECTED
        CPI     KTOTL
        JNZ     ERROR   ;OTHER KEYS NOT VALID NOW
        XRA     A       ;A=0
        JMP     SEL1?
COSEL:                  ;COLUMN 0 SELECTED
        CMA
        ANI     0700    ;SAVE ROW DATA
        RRC
        RRC
        RRC             ;A=KEY NUMBER SELECTED
        JZ      ERROR   ;KEY 0 NOT VALID
SEL1?:                  ;SELECT ?
        MOV     B,A     ;SAVE KEY NUMBER
        MOV     A,C     ;OPERATOR STATUS
        ANA     A
        MOV     A,B     ;RESTORE KEY NUMBER
COND1   SET     1
        JP      PNR1
OPR1:                   ;OPERATOR CODING 1
        CPI     5
        JNC     ERROR   ;KEY 5-7 NOT VALID
        PUSH    B
        CALPTR  O2DATA-O1DATA,OTDATA,MDPP       ;FIND POINTER
        LXI     B,O2DATA-O1DATA ;FIELD WIDTH TO BC
        LXI     H,OTDATA                ;DATA BASE
        LXI     D,MDPP  ;POINTER ADDRESS
        IF      COND1
        ANA     A
        JZ      $+3     ;IF 0 DON'T CHANGE
        ENDIF
        DAD     B       ;ADD FIELD WIDTH
        DCR     A       ;DECREASE LOOP COUNTER
        JNZ     $-2
                        ;FOR START OF OPERATOR DATA
        MVI     C,7     ;NUMBER OF POINTERS TO BE UPDATED
        POP     PSW     ;RESTORE KEY NUMBER AND
        STA     MDCNUM  ;SAVE
        PUSH    H       ;SAVE DATA ADDRESS
        LXI     H,MESSTA;MESSAGE BUFFER FOR CURRENT SELECTION STATUS
        MVI     M,OP    ;"OPR" TO MESSAGE BUFFER
        INX     H
        MVI     M,OP
        JMP     NUMSEL
PNR1:                   ;PRINTER CODING 1
        PUSH    B
        CALPTR  P2DATA-P1DATA,PTDATA,MDGDPP     ;FIND POINTER
        LXI     B,P2DATA-P1DATA ;FIELD WIDTH TO BC
        LXI     H,PTDATA                ;DATA BASE
        LXI     D,MDGDPP        ;POINTER ADDRESS
        IF      COND1
        ANA     A
        JZ      $+3     ;IF 0 DON'T CHANGE
        ENDIF
        DAD     B       ;ADD FIELD WIDTH
        DCR     A       ;DECREASE LOOP COUNTER
        JNZ     $-2
                        ;FOR START OF PRINTER DATA
```

```
COND1   SET     0
        MVI     C,8         ;NUMBER OF POINTERS TO BE UPDATED
        POP     PSW         ;RESTORE KEY NUMBER AND
        STA     MDPNUM      ;SAVE
        PUSH    H           ;SAVE DATA ADDRESS
        LXI     H,MESSTA    ;MESSAGE BUFFER FOR CURRENT SELECTION STATUS
        MVI     M,0P        ;"PR" TO MESSAGE BUFFER
        INX     H
        MVI     M,02
NUMSEL:                     ;NUMBER SELECTED
        INX     H
        MVI     M,D0        ;SPACE
        INX     H
        ANA     A
        PUSH    D           ;SAVE DATA POINTER
        JZ      ALLMES
        MVI     M,D0        ;SPACE
        LXI     D,MESNUM
        INX     D
        DCR     A
        JNZ     $-2
        LDAX    D           ;SELECTED NUMBER CODE TO A
        INX     H
        MOV     M,A         ;NUMBER
        INX     H
        MVI     M,D0        ;SPACE
        JMP     NEXTK1
ALLMES:                     ;ALL MESSAGE
        MVI     M,DA        ;A
        INX     H
        MVI     M,DL        ;L
        INX     H
        MVI     M,DL        ;L
NEXTK1:                     ;NEXT KEY 1
        INX     H
        MVI     M,D0        ;SPACE
        INX     H
        READKB
*       CALL    KBIN        ;READ KEYBOARD
*       RC                  ;GO BACK IF OFF
        POP     D           ;RESTORE DATA POINTER
        CPI     KC          ;KEY C?
        JZ      OFFSET
        CPI     KA          ;KEY A?
        JNZ     ERROR
        MVI     M,DA        ;A
        MOV     A,C         ;POINTERS TO UPDATE TO ACCUM
        LXI     B,0         ;OFFSET VALUE
        JMP     BUFCOR
OFFSET:
        MVI     M,DC        ;C
        MOV     A,C         ;POINTERS TO UPDATE TO ACCUM
        LXI     B,3         ;OFFSET VALUE
BUFCOR:                     ;BUFFER CORRECTION
        POP     H           ;BUFFER ADDRESS
        DAD     B           ;ADD OFFSET VALUE
        CALL    PTRUPD      ;UPDATE POINTERS
        CALL    DISSTA      ;SHOW STATUS MESSAGE
                            ;DISPLAY STATUS
        LXI     H,MDCLR     ;MD CLEAR FLAG
        MOV     A,M
        ANA     A
        JP      KB3         ;IF NOT CLEAR,GO BACK
        XRA     A           ;A=0
        MOV     M,A         ;RESET MD CLEAR FLAG
        MVI     C,0AUH      ;KEYBOARD BLANKING COMMAND CLEAR
FLASH:                      ;FLASH DISPLAY
```

```
        CALL    DELAY   ;256 MSEC DELAY
        MVI     A,03H
        XRA     C       ;TOGGLE BLANKING COMMAND(BITS 0&1)
        MOV     C,A     ;SAVE NEW BLANKING COMMAND
        OUT     KDCOM
        IN      KBRDY
        MOV     B,A     ;SAVE KEYBOARD READY STATUS
        IN      KDON
        ORA     B       ;COMBINE STATUS
        JP      FLASH   ;JUMP IF NO KEY OR OFF
        MVI     A,0A0H  ;UNBLANK DISPLAY COMMAND
        OUT     KDCOM
        CALL    KBIN    ;SEE WHAT HAPPENED
        RC              ;RETURN IF KEYBOARD OFF
        CPI     KCLR
        JNZ     ERROR   ;INVALID KEY DEPRESSED
        LDA     MDOPER
        ANA     A
        JP      PNRCLR  ;IF NOT OPERATOR JUMP TO PRINTER CLEAR
        LHLD    MDPP
        LDA     MDOPNUM ;OPERATOR NUMBER
        ANA     A
        JZ      OTCLR
        MVI     B,3     ;BUFFER TO CLEAR
        JMP     MEMCLR
OTCLR:                  ;OPERATOR TOTAL CLEAR
        MVI     B,15    ;BUFFERS TO CLEAR
        JMP     MEMCLR
PNRCLR:                 ;PRINTER CLEAR
        LHLD    MDSDPP
        LDA     MDPNUM  ;PRINTER NUMBER
        ANA     A
        JZ      PTCLR
        MVI     B,8     ;BUFFERS TO CLEAR
        JMP     MEMCLR
PTCLR:                  ;PRINTER TOTAL CLEAR
        MVI     B,64    ;BUFFERS TO CLEAR
MEMCLR:                 ;MEMORY CLEAR
        XRA     A
        LXI     D,3
LOOPB:          ;LOOP BUFFER
        MVI     C,3
        DI
LOOPC:                  ;LOOP CLEAR
        MOV     M,A     ;CLEAR BYTE
        INX     H       ;INCREMENT POINTER
        DCR     C       ;DECREMENT CLEAR COUNTER
        JNZ     LOOPC
        EI
        DAD     D       ;SKIP NEXT BUFFER
        DCR     B       ;DECREMENT BUFFER COUNTER
        JNZ     LOOPB
        CALL    DISPK   ;BLANK DISPLAY
        JMP     KB2+3   ;GO BACK
;
$INCLUDE(:F1:COL3CK)
;
;ROUTINE:COL3CK
;
;THIS ROUTINE DETERMINES THE FUNCTION TO BE
;PERFORMED FOR COLUMN 3 KEYS.
;
;INPUTS :     B - KEY DATA
;
;DESTROYS:    ALL
;
```

```
COL3CK:                     ;COLUMN 3 CHECK
        LDA     MESSTA
        ANA     A           ;SET FLAGS
        JZ      ERROR       ;ZERO IF NO SELECTION
        MOV     A,B         ;KEY DATA TO ACCUMULATOR
        CPI     KTOTL       ;TOTAL KEY DEPRESSED
        JNZ     $+13
        XRA     A           ;A = 0
        STA     MDPRCT      ;RESET PERCENT KEY
        CALL    DISSTA
        JMP     KB3
        CPI     KREM+1
        JC      PNRKEY      ;GOOD,REMAKE, OR REJECT KEY
        CPI     KHOUR
        JZ      HOURDP      ;HOUR KEY
        LDA     MDOPER
        ANA     A
        MOV     A,B
        JM      OPRKEY      ;JUMP IF OPERATOR SELECTED
TOTDP:                      ;TOTAL DISPLAY
        CPI     KPRNT       ;PRINT KEY
        JZ      $+9
        LHLD    MDTOP       ;POINT TO PRINTER ORDER TOTAL
        JMP     $+6
        LHLD    MDTPP       ;POINT TO PRINTER PRINT TOTAL
        CALL    DISSTA      ;SHOW STATUS
        READKB
+       CALL    KBIN        ;READ KEYBOARD
+       RC                  ;GO BACK IF OFF
        CPI     KTOTL       ;TOTAL KEY?
        JNZ     ERROR       ;WRONG KEY
TOTDP1:                     ;TOTAL DISPLAY 1
        CALL    BIRCDP      ;CONVERT TO BCD
        CALL    DIGITD      ;DISPLAY DIGITS
        JMP     KB3
PNRKEY:                     ;PRINTER KEY
        LDA     MDOPER      ;BIT 7 LO IF PRINTER SELECTED
        ANA     A
        JM      ERROR       ;INVALID KEY
        MOV     A,B         ;KEY DATA
        CPI     KGOOD       ;GOOD KEY?
        JNZ     $+9
        LHLD    MDGDPP      ;POINTER TO GOOD PRINT TOTAL
        JMP     SHOW1
        CPI     KREJ        ;REJECT KEY
        JNZ     $+9
        LHLD    MDRJPP      ;POINTER TO REJECT PRINT TOTAL
        JMP     SHOW1
        LHLD    MDRMPP      ;POINTER TO REMAKE PRINT TOTAL
SHOW1:
        PUSH    H
        CALL    DISSTA      ;SHOW STATUS
        POP     H
        READKB
        CALL    KBIN        ;READ KEYBOARD
        RC                  ;GO BACK IF OFF
        CPI     KPRNT       ;PRINT KEY?
        JNZ     $+11
        XCHG
        LHLD    MDTPP       ;POINTER TO PRINTER PRINT TOTAL
        XCHG
        JMP     CHECKP
        CPI     KORDR       ;ORDER KEY?
        JNZ     ERROR
        LXI     D,4*6       ;ORDER TOTALS OFFSET
        DAD     D           ;MODIFY POINTER
```

```
        XCHG
        LHLD    MDTOP   ;POINTER TO PRINTER ORDER TOTAL
        XCHG
CHECKP:                 ;CHECK PERCENT
        LDA     MOPRCT  ;PERCENT FLAG
        ANA     A
        JP      TOTDP1  ;DISPLAY TOTAL
        MVI     A,80H
        STA     DECPT   ;SET DECIMAL POINT STATUS
        PUSH    D       ;SAVE DIVISOR ADDRESS
        MOV     E,M     ;LOWER 8 BITS OF DIVIDEND
        INX     H
        MOV     D,M     ;MIDDLE 8 BITS
        INX     H
        MOV     A,M     ;UPPER 8 BITS
        XCHG            ;LOWER 16 BITS TO HL
        MOV     E,A     ;UPPER 8 BITS
        MVI     D,0
;
$INCLUDE(:F1:M1000)
;
;ROUTINE: M1000
;
;THE PURPOSE OF THIS ROUTINE IS TO PROVIDE A
;MULTIPICATION BY 1000 OF A 24 BIT BINARY VALUE
;THIS 34 BIT RESULT IS STORED IN FIVE REGISTERS.
;IT PROVIDES A VALUE THAT MAY BE USED TO
;CALCULATE A VALUE IN TENTHS OF A PERCENT.
;
;INPUTS:  D  - EQUAL TO 0
;         E  - UPPER 8 BITS OF 24 BIT VALUE
;         HL - LOWER 16 BITS OF 24 BIT VALUE
;
;OUTPUTS: A  - UPPER 2 BITS OF 34 BIT RESULT
;         DE - MIDDLE 16 BITS OF 34 BIT RESULT
;         HL - LOWER 16 BITS OF 34 BIT RESULT
;
;DESTOYS: ALL REGISTERS AND FLAGS
;
;
M1000:                  ;MULTIPLY 1000
        MVI     B,3     ;LOOP COUNTER = 3
        XRA     A       ;A = 0
        CALL    SHIFT1  ;SHIFT DE, HL LEFT 3
        PUSH    D       ;SAVE RESULT
        PUSH    H
        INR     B       ;LOOP COUNTER = 4
        CALL    SHIFT1  ;SHIFT DE, HL LEFT 1
        PUSH    D       ;SAVE RESULT
        PUSH    H
        MVI     B,6     ;LOOP COUNTER = 6
        CALL    SHIFT1  ;SHIFT A, DE, HL LEFT 6
        PUSH    PSW     ;SAVE ACCUMULATOR
        XRA     A       ;A = 0
ADD1:
        STA     TEMPM   ;SAVE TEMP
        POP     PSW     ;RESTORE ACCUMULATOR
        POP     B       ;LOWER 16 BIT VALUE TO BC
        CALL    BCOMP   ;COMPLEMENT BC
        INR     C       ;INCREMENT
        JNZ     $+4     ;BC FOR 2'S
        INR     B       ;COMPLEMENT
        CZ      INRAD   ;IF ZERO, ADD 1 TO VALUE
                        ;IN REGISTERS A, DE
        DAD     B       ;ADD TWO LOWER 16 BIT VALUES
```

```
        CC      INRAD   ;IF CARRY, ADD 1 TO VALUE
                        ;IN REGISTERS A, DE
        POP     B       ;MIDDLE 16 BIT VALUE TO BC
        CALL    BCOMP   ;COMPLEMENT BC
        XCHG            ;MIDDLE 16 TO DE
        DAD     B       ;ADD TWO MIDDLE 16 BIT VALUES
        XCHG            ;RETURN MIDDLE 16 TO DE
        JNC     $+4     ;IF CARRY,
        INR     A       ;ADD ONE TO ACCUMULATOR
        ADI     0FFH    ;COMPLETE 2'S COMPLEMENT ADDTION
        PUSH    PSW     ;SAVE ACCUMULATOR
        LDA     TEMPM   ;GET TEMP VALUE
        ANA     A       ;SET FLAGS
        JNZ     $+7
        INR     A       ;SET TEMP = 1
        JMP     ADD1
        POP     PSW     ;RESTORE ACCUMULATOR
        JMP     DIVIS
;
$INCLUDE(:F1:OPRKEY)
;
;ROUTINE:OPRKEY
;
;THIS ROUTINE PROVIDES THE MAINLINE PROGRAM
;FLOW FOR OPERATOR DISPLAY OUTPUTS WITH THE
;EXCEPTION OF THE HOURS TOTAL.
;
;INPUTS:        A-CONTAINS KEY DATA
;
;DESTROYS:ALL
;
OPRKEY:
        CPI     KPRNT   ;PRINT KEY?
        JNZ     $+9
        LHLD    MOPP    ;HL CONTAINS ADDRESS OF OPERATOR PRINT TOTAL
        JMP     $+6
        LHLD    MOOP    ;HL CONTAINS ADDRESS OF OPERATOR ORDER TOTAL
        CALL    DISSTA  ;SHOW CURRENT STATUS
        XRA     A
        STA     TEMPM   ;CLEAR
        RE/DKB
+       CALL    KBIN    ;READ KEYBOARD
+       RC              ;GO BACK IF OFF
        CPI     KTOTL   ;TOTAL KEY?
        JZ      TOTOF1
        CPI     KORDR   ;ORDER KEY?
        JNZ     $+10
        PUSH    H
        LHLD    MOOP    ;ADDRESS ORDER TOTAL
        JMP     M10
        CPI     KHOUR   ;HOUR KEY?
        JNZ     ERROR
        PUSH    H
        LHLD    MOTP    ;ADDRESS OF TIME TOTAL
M4096:                  ;MULTIPLY BY 4096
        MVI     A,30H
        STA     TEMPM   ;STATUS FOR 4096 MULTIPLY
M10:                    ;MULTIPLY BY 10
        XTHL
        MOV     E,M     ;LOWER 8 BITS OF DIVIDEND
        INX     H
        MOV     D,M     ;MIDDLE 3 BITS
        PUSH    D
        INX     H
        MOV     C,M     ;UPPER 8 BITS
        MOV     L,C
```

```
        MVI     B,0
        MOV     H,B
        CPI     80H     ;4096 MULTIPLY SET
        JZ      MCONT
        ;
        ;MULTIPLY DIVIDEND BY 10
        ;
        MVI     A,8
LOOPM:                  ;MULTIPLY LOOP
        XTHL            ;LOWER 16 BITS OF RESULT TO HL
        DAD     D       ;ADD ORIGINAL LOWER 16 BITS TO RESULT
                        ;LOWER 16 BITS
        XTHL            ;UPPER 16 BITS OF RESULT
        JNC     $+4     ;SKIP NEXT INSTRUCTION IF NO CARRY
        INX     H
        DAD     B       ;ADD ORIGINAL UPPER 8 BITS TO RESULT
                        ;UPPER 16 BITS
        DCR     A       ;DECREMENT LOOP COUNTER
        JNZ     LOOPM
        MVI     A,80H
        STA     DECPT   ;SET DECIMAL POINT STATUS
MCONT:                  ;MULTIPLY CONTINUE
        XCHG            ;UPPER 16 BITS OF RESULT TO DE
        POP     H       ;LOWER 16 BITS OF RESULT
        LDA     TEMPM   ;MULTIPLY BY 4096 STATUS
        ANA     A       ;SET FLAGS
        MVI     A,0
        JP      DIVIS   ;JUMP IF NOT 4096 MULTIPLY
        MVI     B,12
        CALL    SHIFT1  ;MULTIPLY BY 4096
;
$INCLUDE(:F1:DIVIS)
;
;ROUTINE: DIVIS
;
;THIS ROUTINE WILL DETERMINE THE LOCATION OF THE
;MOST SIGNIFICANT BIT OF THE 3 BYTE VALUE ADDRESSED
;ON THE TOP OF THE STACK. REGISTER PAIR DE CONTAINS THE
;TWO'S COMPLEMENT VALUE OF THE 10 MOST SIGNIFICANT
;BITS. REGISTER C CONTAINS THE NUMBER OF LEADING
;ZEROS WHICH WILL PROVIDE THE INFORMATION TO
;COMPENSATE THE DIVIDEND TO BE USED WITH THE
;DIVISOR DETERMINED IN THIS ROUTINE.
;
;INPUTS: A-UPPER 8 BITS OF DIVIDEND
;        DE-MIDDLE 16 BITS OF DIVIDEND
;        HL-LOWER 16 BITS OF DIVIDEND
;        STACK - POINTS TO LEAST SIGNIFICANT BYTE
;
;OUTPUTS: C - NUMBER OF LEADING ZEROS
;         DE - TWO'S COMPLEMENT OF THE TEN
;              MOST SIGNIFICANT BITS
;
;DESTROYS: ALL REGISTERS AND FLAGS
;
DIVIS:                  ;DIVISOR
        MOV     B,H     ;MOVE HL TO BC
        MOV     C,L
        LXI     H,TEMPM
        MOV     M,C     ;MOVE 40 BIT DIVIDEND TO TEMPM
        INX     H
        MOV     M,B
        INX     H
        MOV     M,E
        INX     H
        MOV     M,D
        INX     H
```

```
        POP     H           ;HL ADDRESS MOST SIGNIFICANT BYTE OF DIVISOR
        INX     H
        INX     H
        MVI     E,3         ;LOOP COUNTER = 3
        MVI     C,0         ;CLEAR ZERO COUNTER
LOOP2:
        MVI     B,8         ;ROTATE COUNTER = 8
        MOV     A,M         ;BYTE TO A
        ANA     A           ;SET FLAGS
        JM      ADJ
        RAL                 ;ROTATE A LEFT
        INR     C           ;INCREMENT ZERO  COUNTER
        DCR     B           ;DECREMENT ROTATE COUNTR
        JNZ     LOOP2+3     ;JUMP IF NOT LAST BIT
        DCR     E           ;DECREMENT LOOP COUNTER
        JZ      KB2-3       ;GO BACK IF DIVISOR IS 0
        DCX     H           ;DECREMENT MEMORY POINTER
        JMP     LOOP2
ADJ:                        ;ADJUST VALUE
        MOV     D,M         ;PRESENT BYTE TO D
        DCX     H           ;DECREMENT MEMORY POINTER
        DCR     E           ;DECREMENT LOOP COUNTER
        JZ      $+12        ;JUMP IF NO SMALLER BYTE
        MOV     A,E         ;MOVE LOOP COUNTER
        MOV     E,M         ;NEXT SMALLER BYTE TO E
        DCR     A
        JZ      $+6
        DCX     H           ;DECREMENT MEMORY POINTER
        MOV     A,M         ;GET LAST BYTE
        RAL                 ;SAVE BIT IN CARRY
        XCHG                ;DE TO HL
        MVI     A,0         ;A = 0
        RAL                 ;BIT TO AC
        MOV     E,A         ;BIT TO E
        MVI     A,2+8       ;2 SHIFTS TO TEN BITS
                            ;PLUS 8 BIT LENGTH
        SUB     B           ;NUMBER OF SHIFTS REQUIRED
        MOV     B,A         ;SHIFT COUNT TO B
        XRA     A           ;A = 0
        DAD     H           ;SHIFT HL LEFT
        RAL                 ;MOVE CARRY BIT TO AO
        DCR     B           ;DECREMENT SHIFT COUNTER
        JZ      ANS1        ;JUMP IF NO MORE SHIFTS
        PUSH    PSW         ;SAVE ACCUMULATOR
        MOV     A,E         ;MERGE BIT WITH L
        ORA     L
        MOV     L,A
        POP     PSW
SHIFT:
        DAD     H           ;SHIFT HL LEFT
        RAL                 ;MOVE CARRY BIT TO AO
        DCR     B           ;DECREMENT SHIFT COUNTER
        JNZ     SHIFT       ;JUMP IF SHIFT NOT COMPLETE
ANS1:                       ;ANSWER 1
        CMA                 ;COMPLEMENT UPPER BYTE A
        MOV     D,A         ;SAVE IN D
        MOV     A,H         ;MOVE LOWER BYTE TO A &
        CMA                 ;COMPLEMENT A
        MOV     E,A         ;SAVE IN E &
        INX     D           ;MAKE ANSWER 2'S COMPLEMENT
;
$INCLUDE(:F1:CUOT)
;
;ROUTINE:CUOT
;
```

```
;THIS ROUTINE DETERMINES THE QUOTIENT BY SUBTRACTING
;THE DIVISOR FROM DIVIDEND AND COUNTING THE
;NUMBER OF TIMES UNTIL THE DIVIDEND REACHES
;ZERO.  THE REMAINDER IS DISREGARDED.
;
;INPUTS:B-NUMBER OF LEADING ZEROS IN DIVISOR
;       DE-TWO'S COMPLEMENT OF DIVISOR
;
;DESTROYS:ALL
;
QUOT:                       ;QUOTIENT
        PUSH    D           ;SAVE DIVISOR
        MOV     B,C         ;LEADING ZEROS IN DIVISOR
        INR     C           ;ADD 2
        INR     B
        LXI     H,TEMPM+4
        MOV     A,M         ;UPPER 8 BITS OF DIVIDEND
        DCX     H
        MOV     D,M         ;MIDDLE 16 BITS
        DCX     H
        MOV     E,M
        LHLD    TEMPM       ;LOWER 16 BITS
        CALL    SHIFT1      ;MATCH DIVIDEND POSITION TO DIVISOR
        XCHG                ;LOWER 16 BITS OF DIVIDEND TO HL
        LXI     B,0         ;QUOTIENT COUNTER=0
        POP     D           ;DIVISOR(2'S COMPLEMENT)
LOOPO:
        DAD     D
        JC      $+7         ;IF NO BORROW, JUMP
        DCR     A
        JM      $+7         ;IF BORROW,JUMP
        INX     B           ;INCREMENT QUOTIENT
        JMP     LOOPO
        LXI     H,TEMPM+2
        XRA     A           ;A=0
        MOV     M,A         ;MOVE 3 BYTE QUOTIENT TO TEMPM
        DCX     H
        MOV     M,B
        DCX     H
        MOV     M,C
        JMP     TOTOP1      ;GO SHOW THE NUMBERS
;
$INCLUDE(:F1:HOURDP)
;
;ROUTINE:HOURDP
;
;THIS ROUTINE WILL CALCULATE THE NUMBER OF HOURS
;TO THE NEAREST TENTH & SET DECIMAL POINT STATUS.
;
;
HOURDP:                     ;HOUR DISPLAY
        LDA     MODEFR      ;BIT 7 HI IF OPERATOR SELECTED
        ANA     A
        JP      ERROR
        CALL    DISSTA
        READKB
        CALL    KBIN        ;READ KEYBOARD
        RC                  ;GO BACK IF OFF
        CPI     KTOTL       ;TOTAL KEY
        JNZ     ERROR
        LHLD    MDTP        ;TIME POINTER
        MOV     E,M         ;LOWEST 8 BITS OF TIME
        INX     H
        MOV     A,M
        ANI     0FH         ;MASK OFF UPPER 4 BITS
        MOV     D,A
        XCHG                ;LOWER 12 BITS OF TIME TO HL
```

```
        XRA     A           ;A = 0
        LXI     B,0FFFFH-208+1
HR10TH:                     ;TENTH OF HOUR
        DAD     B
        JNC     HRUNIT
        INR     A           ;TENTH COUNTER
        CPI     0AH
        JZ      HRUNIT      ;GET OUT IF = 10
        LXI     B,0FFFFH-410+1
        JMP     HR10TH
HRUNIT:                     ;UNITS OF HOURS
        PUSH    PSW
        LDAX    D           ;MIDDLE 8 BITS OF TIME
        RRC                 ;MOVE 4 LOWEST BITS OF
        RRC                 ;TIME TO LOWER 4 BITS
        RRC
        RRC
        ANI     0FH
        MOV     C,A
        INX     D           ;INCREMENT POINTER
        LDAX    D
        RRC                 ;EXCHANGE UPPER AND LOWER 4 BITS
        RRC
        RRC
        RRC
        MOV     B,A
        ANI     0F0H        ;BLANK LOWER 4 BITS
        ORA     C           ;COMBINE LOWER 8 BITS OF UNITS
        MOV     C,A
        MOV     A,B
        ANI     0FH         ;SAVE UPPER 4 BITS OF UNITS
        MOV     B,A
        XRA     A           ;A = 0
        LXI     H,TEMPM+2
        MOV     M,A         ;STORE 0 IN UPPER BYTE
        DCX     H
        MOV     M,B         ;MIDDLE BYTE STORED
        DCX     H
        MOV     M,C         ;LOWER BYTE STORED
        MVI     A,30H
        STA     DECPT       ;DECIMAL POINT STATUS
        POP     PSW
        CPI     10
        JNZ     CONTHR      ;IF 10 ADD 1 TO UNITS OF TIME
        XRA     A
        INR     M
        JNZ     CONTHR      ;IF SPILLOVER, INCREASE NEXT
        INX     H
        INR     M
        DCX     H
CONTHR:                             ;HOURS CONTINUED
        STA     TEMPM       ;SAVE TENTHS
        CALL    BIBCOM
        MVI     B,8
        LXI     H,BCDDAT+7
        LDA     TEMPM       ;GET TENTHS OF HOURS
        MOV     C,M         ;GET NEXT HOUR DIGIT
        MOV     M,A         ;TRANSFER PREVIOUS DIGIT
        MOV     A,C         ;SAVE NEW DIGIT FOR NEXT TRANSFER
        DCX     H           ;DECREMENT POINTER
        DCR     B
        JNZ     $-5         ;DO 8 TIMES
        CALL    DIGITD
        JMP     KB3
;
$INCLUDE(:F1:DIGITD)
;
```

```
;ROUTINE:DIGITD
;
;THIS ROUTINE WILL TAKE THE DIGIT DATA TO BE
;DISPLAYED & CONVERT IT TO SEVEN SEGMENT OUTPUT
;DATA & STORE IN THE DISPLAY SCRATCHPAD. DECIMAL
;POINT STATUS IS CHECKED AND SET ACCORDINGLY.
;
;DESTROYS: ALL
;
;
DIGITD:                 ;DIGIT DISPLAY
        LXI     B,BCDDAT        ;MSD OF BCD DIGIT DATA
        LXI     D,DSPYS ;BEGINNING OF DISPLAY SCRATCHPAD
        XRA     A
        STA     TEMPM   ;CLEAR
LOOP3:
        LXI     H,MESNUM
        LDAX    B       ;BCD DIGIT
        ANA     A
        JNZ     NZERO
        LDA     TEMPM   ;ZERO IF PRECEEDING DIGITS = 0
        ANA     A
        JNZ     NZERO-4 ;DON'T BLANK IF NOT ZEROS
        MVI     A,LOW BCDDAT+7
        CMP     C
        JZ      NZERO-4 ;IF LAST DIGIT DON'T BLANK
        MVI     A,0AH
        JMP     NZERO+3
        XRA     A       ;A = 0
        JMP     $+6     ;SKIP NEXT INSTRUCTION
NZERO:                  ;NO ZERO
        STA     TEMPM   ;MAKE NONZERO
        ADD     L       ;ADJUST POINTER FOR SELECTED DIGIT
        MOV     L,A
        MOV     A,M     ;GET SEGMENT DATA
        STAX    D
        INX     D       ;INCREMENT MESSAGE POINTER
        XRA     A       ;A = 0
        STAX    B
        INX     B
        MVI     A,LOW BCDDAT+8
        CMP     C
        JNZ     LOOP3   ;CHANGE ALL 8 DIGITS
        LXI     D,DECPT
        LXI     H,DSPYS+6
        LDAX    D       ;DECIMAL POINT STATUS
        CMA
        ANA     M       ;MERGE DECIMAL POINT &
                        ;DIGIT DISPLAY DATA
        MOV     M,A     ;RETURN MERGED DATA
        XRA     A       ;A = 0
        STAX    D       ;CLEAR DECIMAL POINT STATUS
        CALL    DISPK   ;SHOW NUMBERS
        RET
;
$INCLUDE(:F1:ASSIGN)
;
;ROUTINE:ASSIGN
;
;THIS ROUTINE ASSIGNS THE PRINTER & OPERATOR FOR
;WHICH DATA IS BEING COLLECTED. PRINTERS MAY BE
;ASSIGNED FROM 1 TO 7 & OPERATORS MAY BE ASSIGNED
;FROM 1 TO 4.  ASSIGNMENT OF 9 FOR OPERATOR OR
;PRINTER CAUSES DATA TO BE STORED IN NONEXISTENT
;MEMORY.  THE PRINTER IS ASSIGNED ON THE FIRST
;PASS & THE OPERATOR IS ASSIGNED ON THE SECOND PASS.
;ADDITIONAL PASSES ALTERNATE THE ASSIGNMENT.
```

```
;INVALID ASSIGNMENTS DO NOT COUNT AS A PASS. ALL
;VALID ASSIGNMENTS WILL CHANGE THE DATA POINTERS TO
;COINCIDE WITH THE NEW ASSIGNMENT.THE CURRENT
;ASSIGNMENTS ARE SHOWN ON THE DISPLAY WITH PRINTER
;ON THE LEFT & OPERATOR ON THE RIGHT.
;
;INPUTS:    NONE
;
OUTPUTS:    NONE

DESTROYS:   A,B,D,E,H,L,F

SSIGN:
        LDA     SPDSL   ;SELECT SWITCH IN
        ANI     0FH     ;MASK OFF UPPER 4 BITS
        JZ      SHOW    ;0 IS INVALID
        MOV     B,A     ;SAVE SELECT NUMBER
        CPI     8       ;CHECK FOR 8
        JZ      SHOW    ;8 IS ARE INVALID
        LXI     H,ASPASS        ;POINTER TO PASS CTR.
        MOV     A,M     ;GET PASS COUNT
        ANA     A       ;SET FLAGS
        MOV     A,B     ;RESTORE SELECTION
        JZ      ASPRTR  ;IF 0, ASSIGN PRINTER
ASOPER:
        CPI     5       ;CARRY SET IF 1-4
        JC      $+8
        CPI     9       ;KEEP 9 FOR TEST
        JC      SHOW    ;5-7 INVALID
        MVI     M,0     ;PASS COUNTER = 0
        INX     H
        INX     H       ;POINTER TO OPER. ASSIGNED NUMBER
        MOV     M,A     ;SAVE OPER. ASSIGNMENT NUMBER
        JC      $+5     ;SKIP NEXT INSTRUCTION IF NOT 9
        MVI     A,(512/(O2DATA-O1DATA))+1
                        ;GET POINTERS TO NONEXISTENT MEMORY
        CALPTR  O2DATA-O1DATA,OTDATA,PRTPTR
        LXI     B,O2DATA-O1DATA ;FIELD WIDTH TO BC
        LXI     H,OTDATA                ;DATA BASE
        LXI     D,PRTPTR        ;POINTER ADDRESS
        IF      COND1
        ANA     A
        JZ      $+8     ;IF 0 DON'T CHANGE
        ENDIF
        DAD     B       ;ADD FIELD WIDTH
        DCR     A       ;DECREASE LOOP COUNTER
        JNZ     $-2
                        ;FIND PTR. FOR START OF OPER. DATA
        MVI     A,3     ;3 POINTERS TO BE UPDATED
        JMP     SHOW-3
ASPRTR:                 ;ASSIGN PTINRTER
        MVI     M,1     ;PASS COUNTER = 1
        INX     H       ;PTR. TO PRINTER ASSIGNED NUMBER
        MOV     M,A     ;SAVE PRINTER ASSIGNMENT NUMBER
        CALPTR  P2DATA-P1DATA,PTDATA,GDPPTR
        LXI     B,P2DATA-P1DATA ;FIELD WIDTH TO BC
        LXI     H,PTDATA                ;DATA BASE
        LXI     D,GDPPTR        ;POINTER ADDRESS
        IF      COND1
        ANA     A
        JZ      $+8     ;IF 0 DON'T CHANGE
        ENDIF
        DAD     B       ;ADD FIELD WIDTH
        DCR     A       ;DECREASE LOOP COUNTER
        JNZ     $-2
        MVI     A,2     ;3 POINTERS TO BE UPDATED
        CALL    PTRUPD  ;POINTER UPDATE
```

```
SHOW:                           ;SHOW ASSIGNMENT
        LXI     H,PTANUM        ;PRINTER ASSIGNMENT NO. ADDR.
        MOV     A,M
        ORI     0F0H            ;UPPER 4 BITS F FOR BLANK
        MOV     D,A
        INX     H               ;OPER.ASSIGNMENT NO. ADDR.
        MOV     A,M
        ORI     0F0H            ;UPPER 4 BITS F FOR BLANK
        CALL    NMOT4
        JMP     WORK
;
$INCLUDE(:F1:BIBCDM)
;
;ROUTINE: BIBCDM
;
;THIS ROUTINE CONVERTS A 24 BIT BINARY VALUE IN
;MEMORY TO AN 8 DIGIT BCD VALUE STORED IN 8 SUCCESSIVE
;MEMORY LOCATIONS.
;
;INPUTS:   HL - POINTS TO LOWER 8 BITS OF BINARY VALUE
;
;DESTROYS: ALL
;
;
BIBCDM:                         ;BINARY TO BCD CONVERSION
        MOV     A,M             ;LOWER 8 BITS OF BINARY VALUE
        INX     H
        MOV     E,M             ;MIDDLE 8 BITS
        INX     H
        MOV     D,M             ;UPPER 8 BITS
        LXI     H,BCDDAT
        PUSH    H               ;SAVE BCD DIGIT POINTER
        MVI     C,98H           ;LOAD 10,000,000 TO C & HL
        LXI     H,9680H
        CALL    UNIT            ;DETERMINE NUMBER OF BCD UNITS
        MVI     C,0FH           ;LOAD 1,000,000 TO C & HL
        LXI     H,4240H
        CALL    UNIT
        MVI     C,1             ;LOAD 100,000 TO C & HL
        LXI     H,86A0H
        CALL    UNIT
        MVI     C,0             ;LOAD 10,000 TO C & HL
        LXI     H,10000
        CALL    UNIT
        LXI     H,1000          ;LOAD 1000 TO C& HL
        CALL    UNIT
        LXI     H,100           ;LOAD 100 TO  HL
        CALL    UNIT
        LXI     H,10            ;LOAD 10 TO HL
        CALL    UNIT
        LXI     H,1             ;LOAD 1 TO L
        CALL    UNIT
        POP     H               ;GET BIB OF BCD POINTER
        RET
;
;
;THIS ROUTINE SUBTRACTS THE CONTENTS OF REGISTERS C & HL
;FROM THE CONTENTS OF REGISTERS DE & A. EACH TIME THE
;REMAINDER IS GREATER THAN OR EQUAL TO ZERO, THE B REGISTER
;(BCD UNIT) IS INCREMENTED. WHEN THE REMAINDER IS LESS THAN
;ZERO, AN ADJUSTMENT IS MADE SO THAT A POSITIVE NUMBER
;REMAINS. THE BCD UNIT IS STORED AT THE POINTER PRECEDING
;THE RETURN ADDRESS ON THE STACK.
;
;INPUTS:     A - LOWER 8 BITS OF BINARY VALUE
;           DE - UPPER 16 BITS OF BINARY VALUE
;            C - UPPER 8 BITS OF BCD VALUE
```

```
;          HL - LOWER 16 BITS OF BCD VALUE
;
;OUTPUTS:    B - NO. OF TIMES C & HL CONTAINED IN DE & A
;            A - LOWER 8 BITS OF NEW BINARY VALUE
;           DE - UPPER 16 BITS OF NEW BINARY VALUE
;
;DESTROYS: A,B,DE,HL,FLAGS
;
;
UNIT:
        MVI     D,0         ;CLEAR BCD UNIT COUNTER
        SUB     L           ;SUBTRACT L8 BCD FROM L8 BINARY
        PUSH    PSW
        MOV     A,E         ;SUBTRACT M8 BCD FROM M8 BINARY
        SBB     H
        MOV     E,A
        MOV     A,D         ;SUBTRACT U8 BCD FROM U8 BINARY
        SBB     C
        MOV     D,A
        JC      ADJUST      ;JUMP IF NEGATIVE RESULT
        INR     D
        POP     PSW
        JMP     UNIT+2
ADJUST:                     ;ADD 24 BIT BCD TO 24 BIT BINARY
        POP     PSW
        ADD     L
        MOV     L,A
        MOV     A,E
        ADC     H
        MOV     E,A
        MOV     A,D
        ADC     C
        MOV     D,A
        MOV     A,L         ;LS BINARY VALUE TO ACC.
        POP     H
        XTHL                ;BCD DIGIT POINTER
        MOV     M,D         ;STORE BCD DIGIT
        INX     H           ;INCREMENT DIGIT POINTER
        XTHL
        PUSH    H
        RET
;
;INCLUDE(:F1:BININC)
;
;ROUTINE:BININC
;
;ENTRY AT 'BININC' WILL INCREMENT THE TWO 3 BYTE HEX VALUES
;BEGINNING AT THE ADDRESS IN THE HL REGISTER.  ENTRY AT
;'BININC1' WILL INCREMENT THE TWO 3 BYTE VALUES IF
;BIT 7 OF ACCUMULATOR IS LOW.
;
;INPUTS: HL-POINTS TO INCREMENT ADDRESS
;          A-BIT 7 LOW FOR INCREMENT
;
;OUTPUTS: HL=INPUT VALUE+6
;
;DESTROYS: HL,FLAGS
;
BININC:
        PUSH    B           ;SAVE BC
        MVI     C,2         ;WORD COUNTER=2
        DI
        STC                 ;SET CARRY FOR START
        MVI     B,3         ;BYTE COUNTER=3
LOOP1:
        JNC     $+7
        MOV     A,M
```

```
        ADI     1           ;INCREMENT BYTE AND MOVE BACK TO MEMORY
        MOV     M,A
        INX     H           ;INCREMENT MEMORY POINTER
        DCR     D           ;DECREASE BYTE COUNT
        JNZ     LOOP1
        DCR     C           ;DECREASE WORD COUNT
        JNZ     LOOP1-3
        POP     B
        EI
        RET
BININC:                     ;BINARY INCREMENT CONDITIONAL
        ANA     A
        JP      BININR      ;IF BIT 7 LOW, INCREMENT MEM
        INX     H           ;ADD 6 TO HL
        INX     H
        INX     H
        INX     H
        INX     H
        INX     H
        RET
;
$INCLUDE(:F1:BCOMP)
;
;ROUTINE: BCOMP
;
;THIS ROUTINE COMPLEMENTS THE VALUE IN
;THE BC REGISTER PAIR.
;
;INPUTS:   BC - VALUE TO BE COMPLEMENTED
;
;OUTPUTS:  BC - COMPLIMENTED VALUE
;
;DESTROYS: B,C
;
;
BCOMP:                      ;BC REGISTER COMPLEMENT
        PUSH    PSW         ;SAVE ACCUMULATOR
        MOV     A,C         ;COMPLEMENT REGISTER C
        CMA
        MOV     C,A
        MOV     A,B         ;COMPLEMENT REGISTER B
        CMA
        MOV     B,A
        POP     PSW         ;RESTORE ACCUMULATOR
        RET
;
$INCLUDE(:F1:DISSTA)
;
;ROUTINE:DISSTA 1-4-79
;
;THIS ROUTINE WILL DISPLAY THE CURRENT STATUS
;MESSAGE ON THE DISPLAY.
;
;DESTROYS:A,B,D,E,FLAGS
;
DISSTA:                     ;DISPLAY STATUS
        PUSH    H
        LXI     H,MESSTA        ;STATUS MESSAGE
        CALL    MESL        ;SHOW STATUS
        POP     H
        RET
;
$INCLUDE(:F1:INRAD)
;
;ROUTINE: INRAD
;
;THIS ROUTINE WILL INCREMENT THE VALUE
```

```
;CONTAINED IN REGISTERS A, DE.
;
;INPUTS:    A  - MOST SIGNIFICANT 8 BITS
;           DE - LEAST SIGNIFICANT 16 BITS
;
;OUTPUTS:   A  - MOST SIGNIFICANT 8 BITS
;           DE - LEAST SIGNIFICANT 16 BITS
;
;DESTROYS: A,D,E, ALL FLAGS EXCEPT CARRY
;
;
INPAD:                      ;INCREMENT REGISTERS A,DE
        INR     E           ;INCREMENT E
        RNZ                 ;IF NOT ZERO, RETURN
        INR     D           ;INCREMENT D
        RNZ                 ;IF NOT ZERO, RETURN
        INR     A           ;INCREMENT A
        RET
;
$INCLUDE(:F1:KBIN)
;
;ROUTINE:KBIN
;
;THIS ROUTINE CHECKS TO SEE THAT THE KEYBOARD
;REMAINS ON.  IF IT IS TURNED OFF THE CARRY FLAG
;IS SET.  ALSO IT LOOKS FOR A KEY DEPRESSION ON THE
;KEYBOARD.  WHEN ONE HAS OCCURRED DECIMAL POINTS ARE
;FLASHED ON THE DISPLAY AND THE KEY POSITION IN
;THE SWITCH MATRIX IS IN THE A-REGISTER ON RETURN.
;
;INPUTS: NONE
;
;OUTPUTS: CARRY FLAG CLEAR IF ON SELECTED
;                A - ROW & COLUMN NUMBER SELECTED
;            CARRY FLAG SET IF OFF SELECTED,A=GARBAGE
;
;DESTROYS:A,FLAGS
;
KBIN:                       ;KEYBOARD INPUT
        IN      KDON        ;KEYBOARD ON STATUS
        RLC                 ;CARRY LOW IF ON
        JNC     $+6
        OUT     DISOF       ;TURN OFF KEYBOARD DISPLAY
        RET
        IN      KBRDY       ;KEY DEPRESSED STATUS
        ANA     A           ;SET FLAGS
        JP      KBIN        ;TRY AGAIN
        PUSH    H
        PUSH    B
        LXI     H,MESDP     ;DECIMAL POINT MESSAGE
        CALL    MESL        ;SHOW MESSAGE
        MVI     A,12        ;12 MSEC
        CALL    DELAY
        CALL    DISPR       ;SHOW BLANK
        POP     B
        POP     H
        IN      KDDATI      ;SWITCH POSITION IN
        RET
;
$INCLUDE(:F1:MESL)
;
;ROUTINE:MESL
;
;THIS ROUTINE LOADS THE MESSAGE TO BE DISPLAYED
;INTO THE DISPLAY SCRATCHPAD.
;
```

```
;INPUTS: HL-POINTS TO THE BEGINNING OF MESSAGE DATA
;
;OUTPUTS: NONE
;
;DESTROYS:A,B,D,E,H,L,FLAGS
;
MESL:                           ;MESSAGE LOAD
        MVI     B,8             ;INITIATE LOOP COUNTER
        LXI     D,DSPYS         ;BEGINNING OF SCRATCHPAD
        MOV     A,M             ;MESSAGE CHARACTER TO A
        STAX    D               ;CHARACTER TO SCRATCHPAD
        INX     D               ;INCREMENT SCRATCHPAD POINTER
        INX     H               ;INCREMENT MESSAGE POINTER
        DCR     B               ;DECREMENT LOOP COUNTER
        JNZ     $-5             ;GO BACK IF NOT FINISHED
;
;THIS ROUTINE WILL OUTPUT THE DATA IN THE DISPLAY
;SCRATCHPAD.  THIS DATA IS ENCODED FOR A SEVEN
;SEGMENT DISPLAY WITH DECIMAL POINT.  BIT 0 THRU 6
;ARE SEGMENTS A THRU G RESPECTIVELY.  BIT 7 REPRESENTS
;THE DECIMAL POINT.  A HIGH WILL CAUSE THE SELECTED
;SEGMENT TO BE TURNED ON.  DATA IS OUTPUTTED FOR AN 8
;CHARACTER DISPLAY.
;
;INPUTS: NONE
;
;OUTPUTS: NONE
;
;DESTROYS:A,B,H,L,FLAGS
;
DISPK:                          ;DISPLAY KEYBOARD
        OUT     DISON           ;TURN ON KEYBOARD DISPLAY
        MVI     B,3             ;INITATE LOOP COUNTER
        LXI     H,DSPYS         ;BEGINNING OF SCRATCHPAD
        IN      KDSTA           ;GET DISPLAY STATUS
        ANA     A               ;SET FLAGS
        JM      $-3             ;GO BACK IF UNAVAILABLE
        MOV     A,M             ;DISPLAY DATA TO ACCUMULATOR
        OUT     KDDATO          ;OUTPUT DISPLAY DATA
        MVI     M,0FFH
        MOV     M,A             ;CLEAR DATA
        INX     H               ;INCREMENT SCRATCHPAD POINTER
        DCR     B               ;DECREMENT LOOP COUNTER
        JNZ     $-8             ;GO BACK AND FINISH
        RET
;
$INCLUDE(:F1:PTRUPD).
;
;ROUTINE:PTRUPD
;
;THIS ROUTINE WILL UPDATE MEMORY POINTERS.
;THE A REGISTER CONTAINS THE NUMBER OF POINTERS
;TO BE UPDATED. HL REGISTER PAIR CONTAINS THE
;ADDRESS STORED IN THE FIRST POINTER. DE REGISTER
;PAIR CONTAINS THE FIRST POINTER. EACH SUCCEEDING
;ADDRESS IS INCREASED BY 6 BEFORE BEING MOVED TO
;THE NEXT POINTER.
;
;INPUTS:  A - NUMBER OF POINTERS TO BE UPDATED
;         HL - DATA ADDRESS
;         DE - POINTER ADDRESS
;
;DESTROYS:     A,B,C,D,E,H,L,F
;
;
PTRUPD:                         ;POINTER UPDATE
```

```
        LXI     B,6
        XCHG
        MOV     M,E         ;LOWER BYTE TO POINTER
        INX     H
        MOV     M,D         ;UPPER BYTE TO POINTER
        INX     H
        XCHG
        DAD     B           ;INCREASE DATA ADDRESS
        DCR     A
        RZ                  ;RETURN IF ALL UPDATES ARE COMPLETE
        JMP     PTRUPD+3
;
$INCLUDE(:F1:SHIFT1)
;
;ROUTINE: SHIFT1
;
;THIS ROUTINE WILL LEFT SHIFT THE VALUE IN THE
;A, DE, HL REGISTERS THE NUMBER OF TIMES INDICATED
;BY THE LOOP COUNTER (REGISTER B). IT CAN BE USED
;TO PROVIDE MULTIPLICATION WITH A 40 BIT RESULT.
;
;INPUTS:  A  - UPPER 8 BITS OF VALUE
;         B  - NUMBER OF LEFT SHIFTS
;         DE - MIDDLE 16 BITS OF VALUE
;         HL - LOWER 16 BITS OF VALUE
;
;OUTPUTS: A  - UPPER 8 BITS OF SHIFTED VALUE
;         DE - MIDDLE 16 BITS OF SHIFTED VALUE
;         HL - LOWER 16 BITS OF SHIFTED VALUE
;
;DESTROYS: ALL REGISTERS AND FLAGS
;
;
SHIFT1:                     ;SHIFT 1
        DAD     H           ;SHIFT LOWER 16 LEFT
        PUSH    PSW         ;SAVE ACCUMULATOR
        MVI     A,0         ;A = 0
        RAL                 ;MOVE CARRY (BIT 17) TO A0
        MOV     C,A         ;SAVE BIT 17 I CO
        POP     PSW         ;RESTORE ACCUMULATOR
        XCHG                ;MIDDLE 16 TO HL
        DAD     H           ;SHIFT MIDDLE 16 LEFT
        RAL                 ;SHIFT UPPER 8 LEFT
        PUSH    PSW         ;SAVE ACCUMULATOR
        MOV     A,L         ;A = LOWER BYTE OF MID. 16
        ORA     C           ;BIT 17 TO MIDDLE 16
        MOV     L,A         ;LOWER BYTE BACK TO L
        XCHG
        POP     PSW         ;RESTORE ACCUMULATOR
        DCR     B           ;DECREMENT LOOP COUNTER
        RZ                  ;IF ZERO COUNT, RETURN
        JMP     SHIFT1      ;OTHERWISE REPEAT
;
$INCLUDE(:F1:TESTKB)
;
;ROUTINE:TESTKB
;
;THIS ROUTINE DOES THE CHECKING OF THE KEYBOARD
;AND UPDATES THE TIME COUNTERS.
;
;DESTROYS:A,FLAGS
;
TESTKB:                     ;TEST KEYBOARD
        IN      KDON        ;KEYBOARD DISPLAY ON
        ANA     A           ;SET FLAGS
        JM      KBOFF
        MVI     A,5         ;SET A FOR 5 MSEC DELAY
```

```
        CALL    DELAY   ;DEBOUNCE SWITCH
        IN      KDCM    ;CHECK AGAIN
        CP      KB1     ;GO TO KEYBOARD DISPLAY IF ON
        JNC     $+7     ;JUMP IF NOT RETURNING FROM CALL
        MVI     A,0DDH  ;DISPLAY RAM TO ZEROS
        OUT     KDCOM   ;COMMAND TO KEYB/DISPLY
        XRA     A       ;A=0
        STA     TIMETP  ;CLEAR TIME TEMPORY
KBOFF:                  ;KEYBOARD OFF
        CALL    TIMUPD
;
$INCLUDE(:F1:TIMUPD)
;
;ROUTINE:TIMUPD
;
;THIS ROUTINE WILL UPDATE THE TIME COUNTS
;UNTIL THE TIME TEMPORARY COUNT IS ZERO.
;
;DESTROYS: NONE
;
;
TIMUPD:                 ;TIME UPDATE
        PUSH    PSW
        PUSH    D
        PUSH    H
        LXI     H,TIMETP
        MOV     A,M     ;GET TIME TEMPORARY COUNT
        ORA     A       ;SET FLAGS
TEST6:
        JZ      TIMRET
        XCHG            ;SAVE TIMETP
        LHLD    TIMPTR  ;ADDRESS OF ASSIGNED OPERATOR
                        ;TIME COUNT
        MOV     A,L     ;L=0 IF NOT ASSIGNED
        ORA     A       ;SET FLAGS
        JNZ     CONTTM
        XCHG
        DCR     M       ;DUMP UNASSIGNED TIME
TIMRET:                 ;TIME RETURN
        POP     H
        POP     D
        POP     PSW
        RET
CONTTM:                 ;CONTINUE TIME UPDATE
        CALL    TIMING  ;INCREMENT ASSIGNED OPERATOR TIME
        XCHG
        DCR     M
        JMP     TEST6
;
$INCLUDE(:F1:TOTUPD)
;
;ROUTINE:TOTUPD
;
;THIS ROUTINE WILL GENERATE A TOTAL SUM OF 3
;BYTES FOR ALL THE INDIVIDUAL TOTALS OF 3 BYTES.
;ON ENTRY HL CONTAINS THE ADDRESS OF THE FIRST TOTAL
;SUM.  DE CONTAINS THE FIELD WIDTH FOR EACH SET
;OF TOTALS.  B CONTAINS THE NUMBER OF FIELDS TO BE
;TOTALIZED.  C CONTAINS THE QUANTITY OF TOTALS IN
;EACH FIELD TO BE SUMMED.
;
;INPUTS:         B -NUMBER COUNTS
;                C -SUM COUNT
;                DE-ADDRESS OFFSET TO NEXT LIKE TOTAL
;                HL-ADDRESS OF DATA TOTAL
;
;DESTROYS:       ALL
;
```

```
TOTUPD:                         ;TOTALS UPDATE
        PUSH    H               ;SAVE DATA ALL TOTAL ADDRESS
        PUSH    B               ;SAVE NUMBER AND SUM COUNT
        XRA     A               ;UPPER 8 BITS OF SUM=0
        PUSH    H               ;LOWER 16 BITS OF SUM=0 & PUT ON STACK
        LXI     H,0
        XTHL
LOOPTN:                         ;LOOP TOTAL NUMBER
        DAD     D               ;ADD FIELD WIDTH FOR ADDRESS OF NEXT TOTAL
        XCHG                    ;SAVE FIELD WIDTH BEHIND LOWER 16 BITS OF SUM
        XTHL
        PUSH    H
        XCHG
;
;CURRENT REGISTER CONTENTS
;A-UPPER 8 BITS OF SUM
;B-NUMBER COUNT
;HL-DATA TOTAL ADDRESS OF SELECTED FIELD
;STACK-LOWER 16 BITS OF SUM
;STACK+2-FIELD WIDTH(OFFSET)
;STACK+4-NUMBER AND SUM COUNT
;STACK+6-ADDRESS OF TOTAL SUM
;
        MOV     E,M             ;GET SELECTED FIELD TOTAL
        INX     H
        MOV     D,M
        INX     H
        MOV     C,M
        XTHL                    ;GET LOWER 16 BITS OF SUM
        DAD     D               ;ADD SELECTED TOTAL TO SUM
        ADC     C
        POP     D               ;SEE NEXT FOLLOWING REGISTER CONTENT
        XTHL
        XCHG
        DCX     H
        DCX     H
;
;CURRENT REGISTER CONTENTS
;A-UPPER 8 BITS OF SUM
;B-NUMBER COUNT
;DE-FIELD WIDTH(OFFSET)
;HL-DATA TOTAL ADDRESS OF SELECTED FIELD
;STACK-LOWER 16 BITS OF SUM
;STACK+2-NUMBER AND SUM COUNT
;STACK+4-ADDRESS OF TOTAL SUM
;
        DCR     B               ;DECREMENT NUMBER COUNT
        JNZ     LOOPTN          ;CONTINUE ADDITION IF NOT COMPLETE
        POP     H               ;LOWER 16 BITS OF SUM TO DE
        XCHG
        POP     B               ;NUMBER AND SUM COUNT
        XTHL                    ;ADDRESS OF TOTAL SUM TO HL,FIELD
                                ;WIDTH TO STACK
        MOV     M,E             ;STORE 24 BIT TOTAL SUM
        INX     H
        MOV     M,D
        INX     H
        MOV     M,A
        INX     H
        POP     D               ;FIELD WIDTH(OFFSET)
        DCR     C               ;DECREMENT SUM COUNT
        JNZ     TOTUPD          ;REPEAT IF SUM COUNT NOT EQUAL 0
        RET
;
$INCLUDE(:F1:TUP1)
;
```

```
;ROUTINE:TUP1
;
;THIS ROUTINE WILL UPDATE THE PRINT TOTALS FOR
;THE APPROPRIATE OPERATOR AND/OR PRINTER.
;
TUP1:                       ;TOTAL UPDATE 1
        INX     H           ;GOOD ORDER STATUS
        ORA     M           ;UPDATE GOOD ORDER STATUS
        MOV     M,A
        LHLD    GOPPTR      ;PRINTER GOOD PRINTS ADDRESS
        MOV     A,E         ;GOOD PRINT STATUS
        CALL    BININC      ;IF GOOD PRINT, INCREMENT
        CALL    BININR      ;INCREMENT PRINT TOTAL
        IN      RJECT       ;GET REJECT STATUS
        CALL    BININC      ;IF REJECT PRINT,INCREMENT
        MOV     A,D         ;REMAKE STATUS
        CALL    BININC      ;IF REMAKE PRINT, INCREMENT
        INX     SP          ;SAVE GOOD
        INX     SP          ;ORDER ADDRESS
        XTHL                ;G.O.A.->HL, G.P.A.-> ST
        DCX     SP          ;SAVE GOOD
        DCX     SP          ;PRINTS ADDRESS
        XTHL                ;RET->HL, G.O.A.->ST
        PUSH    H           ;RET->ST
        LHLD    PRTPTR      ;OPERATOR PRINT ADDRESS
        CALL    BININR      ;INCREMENT OPERATOR PRINT TOTAL
        RET
;
$INCLUDE(:F1:TUP2)
;
;ROUTINE:TUP2
;
;THIS ROUTINE WILL UPDATE THE ORDER TOTALS FOR
;THE APPROPRIATE OPERATOR AND/OR PRINTER.
;
TUP2:                       ;TOTAL UPDATE 2
        MOV     A,B         ;END OF ORDER STATUS
        ANA     A           ;SET FLAGS
        POP     D           ;RET --> DE
        XCHG                ;RET->HL, R.P.A.->DE
        XTHL                ;PRINT TOTAL OUT, GOOD ORDER IN
        PUSH    D           ;RET->ST
        JP      TUPEND-2
        LXI     D,GOORD     ;GOOD ORDER STATUS ADDRESS
        LDAX    D
        CALL    BININC      ;IF GOOD ORDER, INCREMENT
        CALL    BININR      ;INCREMENT ORDER TOTAL
        DCX     D           ;REJECT ORDER STATUS
        LDAX    D
        CALL    BININC      ;IF REJECT ORDER, INCREMENT
        DCX     D           ;REMAKE ORDER STATUS
        LDAX    D
        CALL    BININC      ;IF REMAKE ORDER, INCREMENT
        LHLD    ORDPTR      ;ORDER TOTAL ADDRESS
        CALL    BININR      ;INCREMENT ORDER TOTAL
        POP     H           ;PRINT TOTAL ADDRESS
        RET
TUPEND:                     ;TOTAL UPDATE END
;
$INCLUDE(:F1:DBMD)
;
;ROUTINE: DBMD
;
;THIS ROUTINE DEFINES THE MESSAGES & NUMBERS TO BE
;DISPLAYED FOR THE MANAGEMENT DATA OPTION. THE "D"
;PRECEEDING EACH CHARACTER IS NOT DISPLAYED IT SIGNIFIES
;7 SEGMENT DISPLAY DATA.  "D" REPRESENTS A SPACE.
```

```
;
MESON:                  ;SIGN ON MESSAGE
        DB      D0,DP,DZ,D0

        DB      D3,DO,D5,D0

MESERR:                 ;ERROR MESSAGE
        DB      D0,D0,DE,DR

        DB      DR,DO,DR,D0

MESDP:                  ;DECIMAL POINT MESSAGE
        DB      DDP,DDP,DDP,DDP

        DB      DDP,DDP,DDP,DDP

MESNUM:                 ;NUMBERS(UPPER 2 CHARACTERS OF
                        ;ADDRESS MUST BE THE SAME)
        DB      D0,D1,D2,D3,D4

        DB      D5,D6,D7,D8,D9,D0

MESTES:                 ;TEST MESSAGE
        DB      DT,DT,DT,DT

        DB      DT,DT,DT,DT

;
;INCLUDE(:F1:MDSTOR)
;
;ROUTINE:MDSTOR
;
;THIS ROUTINE DEFINES THE STORAGE REQUIRED FOR
;MANAGEMENT DATA. IT IS BROKEN INTO TWO GROUPS,
;OPERATOR & PRINTER DATA COUNTS. EACH DATA
;COUNT IS COMPRISED OF 2 BYTES WITH THE LEAST
;SIGNIFICANT BYTE IN THE LOWEST MEMORY LOCATION
;EACH PARAMETER IS TOTALIZED IN TWO DATA COUNTS
;WHICH ARE ADJACENT TO EACH OTHER IN MEMORY.
;IN ADDITION TO INDIVIDUAL COUNTS, OVERALL
;COUNTS ARE ALSO MAINTAINED.
;
;
```

```
        ORG     0F800H
OTDATA:                         ;OPERATOR TOTALS DATA
OTPRT:  DS      6               ;PRINT COUNTS
OTORD:  DS      6               ;ORDER COUNTS
OTTIME: DS      6               ;TIME COUNTS
O1DATA: DS      18              ;OPERATOR 1 DATA
O2DATA: DS      18              ;OPERATOR 2 DATA
O3DATA: DS      18              ;OPERATOR 3 DATA
O4DATA: DS      18              ;OPERATOR 4 DATA
;
PTDATA:                         ;PRINTER TOTALS DATA
PTGOPR: DS      6               ;GOOD PRINTS
PTTPR:  DS      6               ;TOTAL PRINTS
PTRJPR: DS      6               ;REJECT PRINTS
PTRMPR: DS      6               ;REMAKE PRINTS
PTGOOR: DS      6               ;GOOD ORDERS
PTTOR:  DS      6               ;TOTAL ORDERS
PTRJOR: DS      6               ;REJECT ORDERS
PTRMOR: DS      6               ;REMAKE ORDERS
P1DATA: DS      48              ;PRINTER 1 DATA
P2DATA: DS      48              ;PRINTER 2 DATA
P3DATA: DS      48              ;PRINTER 3 DATA
P4DATA: DS      48              ;PRINTER 4 DATA
P5DATA: DS      48              ;PRINTER 5 DATA
P6DATA: DS      48              ;PRINTER 6 DATA
P7DATA: DS      48              ;PRINTER 7 DATA
;
        ORG     0F850H
REMORD: DS      1               ;BIT 7 LO IF REMAKE ORDER
REJORD: DS      1               ;BIT 7 LO IF REJECT ORDER
GOORD:  DS      1               ;BIT 7 LO IF GOOD ORDER
ASPASS: DS      1               ;ASSIGN PASS COUNTER
PTANUM: DS      1               ;PRINTER ASSIGNED NUMBER
OANUM:  DS      1               ;OPERATOR ASSIGNED NUMBER
;
                                ;POINTER TO ASSIGNED OPER.
PRTPTR: DS      2               ;PRINT COUNT
ORDPTR: DS      2               ;ORDER COUNT
TIMPTR: DS      2               ;TIME COUNT
;
                                ;POINTER TO ASSIGNED PRINTER
GDPPTR: DS      2               ;GOOD PRINT COUNT
TPPTR:  DS      2               ;TOTAL PRINT COUNT
RJPPTR: DS      2               ;REJECT PRINT COUNT
```

TABLE 2

```
RMPPTR: DS      2               ;REMAKE PRINT COUNT
GDOPTR: DS      2               ;GOOD ORDER COUNT
TOPTR:  DS      2               ;TOTAL ORDER COUNT
RJOPTR: DS      2               ;REJECT ORDER COUNT
RMOPTR: DS      2               ;REMAKE ORDER COUNT
;
DSPYS:  DS      8               ;DISPLAY SCRATCH PAD
TIMETP: DS      1               ;TEMP. COUNT OF TIME INTERRUPTS
;
MDPP:   DS      2               ;MGMT. DATA PRINT POINTER
MDOP:   DS      2               ;MD ORDER POINTER
MDTP:   DS      2               ;MD TIME POINTER
MDGDPP: DS      2               ;MD GOOD PRINT POINTER
MDTPP:  DS      2               ;MD TOTAL PRINT POINTER
MDRJPP: DS      2               ;MD REJECT PRINT POINTER
MDRMPP: DS      2               ;MD REMAKE PRINT POINTER
MDGDOP: DS      2               ;MD GOOD ORDERS POINTER
MDTOP:  DS      2               ;MD TOTAL ORDERS POINTER
```

```
MDRJOP: DS      2       ;MD REJECT ORDERS POINTER
MDRMOP: DS      2       ;MD REMAKE ORDERS POINTER
;
MDOPNUM: DS     1       ;MD OPERATOR NUMBER
MDPNUM: DS      1       ;MD PRINTER NUMBER
MDCLR:  DS      1       ;BIT 7 HI IF MD CLEAR OPERATION SELECTED
MDPRCT: DS      1       ;MD BIT 7 HI IF "PER CENT"
                        ;DATA REQUESTED
MDOPER: DS      1       ;MD BIT 7 HI IF OPER. DATA REQUESTED
MDCTOT: DS      1       ;MD BIT 7 HI IF "C" TOTALS REQUESTED
;
DECPT:  DS      1       ;BIT 7 HI IF DECIMAL POINT REQUIRED
BCDDAT: DS      8       ;CONTAINS BCD DIGITS TO BE DISPLAYED
                        ;STARTING WITH MOST SIGNIFICANT
TEMPM:  DS      6       ;TEMPORARY STORAGE
;
MESSTA: DS      8       ;MESSAGE AREA FOR CURRENTLY
                        ;SELECTED OPERATOR/PRINTER
        END

RRORS
;////////////////////////////////////////////////
;THIS ROUTINE CHECKS THE REMAKE & REJECT PRINT
;STATUS AND INCREMENTS THE APPROPRIATE PRINT TOTALS
;IN BOTH VOLITLE AND NON-VOLITLE MEMORY. IT UPDATES
;STATUS OF THE GOOD, REMAKE, & REJECT ORDERS &
;INCREMENTS THE APPROPRIATE ORDER TOTALS AT THE END
;OF AN ORDER.
;
;
;INPUTS:   HL - POINTS TO VOLATLE REJECT PRINT TOTAL
;
;OUTPUTS:  HL - POINTS TO VOLATLE PRINT TOTAL
;
;DESTROYS: A,D,E,H,L,FLAGS
;
;
        IN      REJCT
        MOV     E,A     ;SAVE REJECT STATUS
        CALL    ECOUN+1 ;REJECT? INCREMENT
        IN      RMAKE
        MOV     D,A     ;SAVE REMAKE STATUS
        PUSH    H       ;SAVE REMAKE PRINT ADDRESS
        LXI     H,REMORD        ;REMAKE ORDER STATUS ADDRESS
        ANA     M       ;UPDATE REMAKE ORDER STATUS
        MOV     M,A
        INX     H       ;REJECT ORDER STATUS
        MOV     A,E
        ANA     M       ;UPDATE REJECT ORDER STATUS
        MOV     M,A
        MOV     A,D     ;GET REMAKE STATUS
        ANA     E       ;AT LO IF REMAKE OR REJECT
        XRI     80H     ;AT LO IF GOOD PRINT
        MOV     E,A     ;SAVE GOOD PRINT STATUS
        LDA     MDATA   ;GET MGMT. DATA STATUS
        ANA     A       ;SET FLAGS
        MOV     A,E     ;GET GOOD PRINT STATUS
        CM      TOR1    ;IF MGMT. DATA, UPDATE TOTALS
        IN      CORRC   ;BIT 5 LO IF FILM CUTTER CONNECTED
                        ;CND PACKER (OR PRICING TERMINAL)
        RLC             ;MOVE BIT 5 TO
        RLC             ;BIT 7 POSITION
        ANA     A       ;SET FLAGS
        JP      CONTA   ;JUMP IF FILM CUTTER CONNECTED
        IN      PACK
        CMA
        ORA     D       ;REMAKE STATUS
        JM      S+5     ;SKIP NEXT INSTUCTION IF NOT REMAKE
```

```
                        ;PRINT OR PACKER IS CONNECTED
        OUT     REMSGN  ;SEND REMAKE SIGNAL TO ORDER STATION
CONTA:                  ;CONTINUE A
        POP     H       ;RESTORE REMAKE PRINT ADDRESS
        MOV     A,D     ;REMAKE STATUS
        CALL    BCDIN+1 ;REMAKE? INCREMENT
        MOV     A,E     ;GOOD PRINT STATUS
        CALL    BCDIN+1 ;GOOD PRINT? INCREMENT
        LDA     MDATA   ;GET MCMT. DATA STATUS
        ANA     A       ;SET FLAGS
        CM      TMP2    ;IF MCMT.DATA, UPDATE TOTALS
;
;////////////////////////////////////////////////////////
        CALL    BCDIN   ;INCREMENT TOTAL PRINT COUNT
        POP     D       ;GET FEED LENGTH
        INX     H       ;M=CTMNK(CUT MARK NEW)
        MOV     A,M     ;CUT MARK THIS CUT
        ANA     A       ;SET FLAGS
        INX     H       ;M=CTMOD(CUT MARK OLD)
        JP      CTOLY   ;IF NO CUT MARK JUMP
        CMP     M
        JNZ     CTOLY   ;JUMP IF LAST PRINT NO CUT MARK
        MVI     A,MXMCM ;MAX MISSING CUT MARKS
        STA     MISCM   ;STORE ABOVE
        XCHG
        SHLD    PFD1    ;STORE FEED LENGTH OF LAST PRINT
        JMP     CTOLY+1
CTOLY:                  ;CUT DELAY FOR KNIFE RETURN
        MOV     M,A     ;CUT MARK STATUS FOR NEXT PRINT
        CALL    KNIFEN  ;KNIFE HOME YET?
        OUT     PCTOF   ;PRINT CUT(OFF) TO PACKER
        LDA     CTOTM   ;CUT OUT LENGTH
        ANA     A       ;SET FLAGS
        JZ      TEST2   ;IF NO CUT OUT, JUMP
        OUT     SMRUN
        MOV     D,A     ;SAVE CUT OUT LENGTH
CLK2:
        CALL    CLK     ;CHECK STEP COMPLETE
        DCR     D       ;DECREASE CUT OUT LENGTH
        JNZ     CLK2    ;TO MOVE M IF NOT ZERO JUMP
        OUT     SMSTP
        CALL    TRIM
        CALL    KNIFEN  ;WAIT FOR KNIFE TO COMPLETE CYCLE
TEST2:
        XRA     A       ;A = 0
        STA     LONGFD  ;RESET LONG FEED
FOO2:                   ;END OF ORDER?
        MVI     A,80H
        STA     PWRON   ;SET FIRST PRINT OUT STATUS
        CMP     B       ;END OF ORDER?
        JZ      HOLD    ;YES, GO WAIT FOR NEXT ORDER
        MOV     A,C     ;MAX COUNT STATUS
        ANA     A       ;SET FLAGS
        JNZ     WHY5+6
WHY5:
        CALL    STOPS
        JMP     HOLD
        LXI     H,SPDSL ;SPEED SELECT
        LXI     D,MYDPM ;MAX PRINTS MEMORY
        JMP     PSTAR   ;START NEXT PRINT
HOLD:
        MVI     A,20
        CALL    DELAY
        JMP     WORK
;
;ACCESORY TEST
;
```

```
;THIS SECTION WILL TEST THE PS305 PRINT SORTER AND THE
;DATA MANAGEMENT KEYBOARD/DISPLAY UNIT.
;
;THE SORTER TEST IS CONTROLED BY SELECTING A FUNCTION
;ON THE "SPEED SELECT" SWITCH AND PRESSING THE "TRIM"
;SWITCH TO INITIATE THE TEST.
;THE SETTINGS AND THEIR FUNCTION ARE AS FOLLOWS:
;
;"0" - TURN ON THE SORTER POWER SUPPLY
;"1" - TURN ON THE PAD PRINT SOLENOID
;"2" - TURN ON THE REJECT PRINT SOLENOID
;"3" - TURN OFF THE SORTER POWER SUPPLY
;
;THE SOLENOIDS ARE TURNED OFF WHEN "TRIM" IS RELEASED.
;
;THE KEYBOARD/DISPLAY TEST MAY BE ACCESSED ANYTIME IN THIS
;SECTION BY SLIDING THE "ON/OFF" SWITCH OF THE UNIT TO THE "ON"
;POSITION. THIS WILL LIGHT ALL USABLE LEDS OF THE DISPLAY.
;PRESSING ANY KEY WILL DISPLAY A TWO DIGIT NUMBER REPRESENTING
;THE COLUMN AND ROW OF THAT SWITCH IN THAT ORDER.
;TO EXIT THE KEYBOARD/DISPLAY TEST, SLIDE THE "ON/OFF" SWITCH TO "OFF"
;
;
ATEST:
        LDA     SORTER          ;GET SORTER STATUS
        MOV     E,A
        LDA     MDATA
        ORA     B               ;SET FLAGS
        JP      LTEST           ;IF NO SORTER, SKIP THIS SECTION
        MVI     D,0FFH          ;LOAD D WITH FFH
        MVI     A,0FFH          ;LOAD A WITH FFH
        CALL    NNOT4           ;BLANK PC305 DISPLAY
SRTEST:
        LDA     IDVSW           ;GET SWITCH STATUS
        ANI     02H             ;SAVE ONLY "TRIM" STATUS
        JZ      NOTRIM          ;JUMP IF "TRIM" NOT ON
        MVI     A,5             ;LOAD A FOR 5 MS. DELAY
        CALL    DELAY           ;DEBOUNCE SWITCH
        LDA     IDVSW           ;GET SWITCH STATUS AGAIN
        ANI     02H             ;SAVE ONLY "TRIM" STATUS
        JZ      NOTRIM          ;JUMP IF "TRIM" NOT STILL ON
        LDA     SPDSL           ;GET SPEED SWITCH DATA
        ANI     0FH             ;SAVE ONLY ALSD
        CPI     0               ;SPEED SELECT = 0?
        JNZ     $+8             ;IF NOT 0, SKIP NEXT 2 LINES
        OUT     SORON           ;TURN SORTER ON
        JMP     SRTEST          ;WAIT FOR NEXT COMMAND
        CPI     01H             ;SPEED SELECT = 1?
        JNZ     $+8             ;IF NOT 1, SKIP NEXT 2 LINES
        OUT     BDSON           ;TURN BAD SOLENOID ON
        JMP     SRTEST          ;WAIT FOR NEXT COMMAND
        CPI     02H             ;SPEED SELECT = 2?
        JNZ     $+8             ;IF NOT 2, SKIP NEXT 2 LINES
        OUT     RJSON           ;TURN REJECT SOLENOID ON
        JMP     SRTEST          ;WAIT FOR NEXT COMMAND
        CPI     03H             ;SPEED SELECT = 3?
        JNZ     SRTEST          ;IF NOT 3, WAIT FOR NEXT COMMAND
        OUT     SOROF           ;TURN SORTER OFF
        JMP     SRTEST          ;WAIT FOR NEXT COMMAND
NOTRIM:
        OUT     BDSOF           ;TURN BAD SOLENOID OFF
        OUT     RJSOF           ;TURN REJECT SOLENOID OFF
        IN      KDON            ;GET KEYBOARD STATUS
        ANA     A               ;SET FLAGS
        JM      $+13            ;IF OFF, SKIP NEXT 4 LINES
        MVI     A,5             ;LOAD A FOR 5 MS. DELAY
        CALL    DELAY           ;DEBOUNCE SWITCH
        IN      KDON            ;GET KEYBOARD STATUS
```

```
        ANA     A               ;SET FLAGS
        JP      KEYBRD          ;IF STILL ON, SERVICE KEYBOARD
        CALL    ADVAN           ;IF OFF, CHECK FOR ADVANCE OR EXIT
        JNZ     SRTEST          ;WAIT FOR NEXT COMMAND
        JMP     LTEST           ;START PROGRAM AGAIN
KEYBRD:
        MVI     A,10H           ;COMMAND WORD FOR 8 CHARCTER DISPLAY,
                                ;RIGHT ENTRY, ENCODED 2 KEY ROLLOVER
        OUT     KDCOM           ;SEND COMMAND WORD TO 8279
        XRA     A               ;A = 0
        STA     KDCLR           ;KDCLR = 0
        LXI     H,MESTES        ;ADDRESS FOR TEST MESSAGE
        CALL    MESL            ;LIGHT ALL LEDS ON DISPLAY
KEYLOP:
        CALL    ADVAN           ;CHECK FOR ADVANCE OR EXIT
        CALL    KBIN            ;SEE IF K/D ON & WAIT FOR KEY PRESSED
        JC      BLANKD          ;IF K/D OFF, BLANK DISPLAY
        MOV     B,A             ;SAVE KEY LOCATION DATA
        ANI     03H             ;SAVE ONLY COLUMN INFO.
        STA     BCDDAT+6        ;STORE COLUMN INFO.
        MOV     A,B             ;GET LOCATION DATA
        CMA                     ;COMPLEMENT
        ANI     38H             ;SAVE ONLY ROW INFO.
        RRC                     ;SHIFT DATA
        RRC                     ;RIGHT 3
        RRC                     ;PLACES
        STA     BCDDAT+7        ;STORE ROW INFO.
        MVI     A,0AH           ;LOAD A WITH CODE FOR SPACE
        STA     BCDDAT+5        ;STORE TO UNBLANK 1 LEADING ZERO
        CALL    DIGITD          ;DISPLAY KEY LOCATION
        JMP     KEYLOP          ;WAIT FOR NEXT KEY
BLANKD:
        OUT     DISOF           ;TURN OFF DISPLAY
        JMP     SRTEST          ;WAIT FOR NEXT COMMAND
;
;ROUTINE:STORGE
;
        ORG     DSTOR
SWSTM:  DS      1               ;STATUS OF PB & TOGGLE SWITCHES
MCTMS:  DS      1               ;BIT 7 HI,NO CUT MARK STATUS
LONFO:  DS      1               ;BIT 7 HI IF NEW PAPER ROLL
MXPRK:  DS      1               ;MAX NUMBER PRINTS THIS ORDER(BCD)
CTOTM:  DS      1               ;CUT OUT LENGTH-MEMORY(BINARY)
ACTF1:  DS      1               ;2 LSD,FEED AFTER CT MARK(BINARY)
ACTF2:  DS      1               ;MSD,FEED AFTER CUT MARK(BINARY)
MSPDS:  DS      1               ;BIT 7 HI,AT MAX SPEED
MXSPD:  DS      1               ;MAX SPEED
RSTPN:  DS      1               ;RAMP STEP #
URAPS:  DS      1               ;BIT 7 HI,RAMP UP STATUS
RRPDN:  DS      1               ;BIT 7 HI,READY TO RAMP DOWN
ACTM:   DS      1               ;BIT 7 HI,LOOKING FOR END OF PRT
CTVAL:  DS      1               ;BIT 7 HI,CUT MARK IS ACCEPTABLE
MISCM:  DS      1               ;CUT MARK YET TO MISS
FFD1:   DS      1               ;2 LSD OF FEED LAST CUT(BINARY)
FFD2:   DS      1               ;MSD OF FEED LAST CUT(BINARY)
PRCT:   DS      1               ;# OF PRINTS CUT THIS ORDER(BCD)
SPRCT:  DS      1               ;# OF SALEABLE PRINTS CUT THIS ORDER(BCD)
FLAGM:  DS      1               ;STORES FFH TO BLANK DISPLAY
ORDCT:  DS      2               ;# ORDERS TOTAL(BCD)
REJPR:  DS      3               ;# OF REJECT PRINTS(BCD)
REMPR:  DS      3               ;# OF REMAKE PRINTS(BCD)
GDPR:   DS      3               ;# OF GOOD PRINTS(BCD)
PRCT1:  DS      3               ;# PRINTS CUT TOTAL(BCD)
CTMNW:  DS      1               ;BIT 7 HI,CUT MARK ON PRESENT
                                ;(NEW) CUT
CTMOL:  DS      1               ;BIT 7 HI,CUT MARK ON PREVIOUS
                                ;(OLD) CUT
```

```
STOPM:   DS    1      ;BIT 7 HI,STOP SELECTED SINCE
                      ;LAST CUT
MFDL:    DS    2      ;MEASURED FEED LENGTH(BCD)
MFDAC:   DS    2      ;MEASURED FEED LENGTH AFTER
                      ;CUT MARK(BCD)
PWRON:   DS    1      ;BIT 7 HI IF PRINTS HAVE BEEN CUT
                      ;SINCE POWER ON & NO ERROR IN LAST ADVANCE
TOT1?:   DS    1      ;BIT 7 HI IF FIRST TOTAL HAS
                      ;BEEN DISPLAYED
DIPAC:   DS    1      ;BIT 7 HI IF UPPER FOUR DIGITS ARE
                      ;TO BE DISPLAYED NEXT
CTELY:   DS    1      ;BIT 7 HI IF CUT SOLENOID IS TO BE
                      ;ENERGIZED EARLY WHEN RAMP DOWN BEGINS
REQCM:   DS    1      ;BIT 7 HI IF CUT MARKS REQUIRED ON ALL PRINTS
WHY:     DS    2      ;CONTAINS ADDRESS OF REASON FOR PAPER CUTTER ST
DEOO:    DS    1      ;BIT 6 HI IF NEXT PRINT IS END OF ORDER,
FCCNT:   DS    1      ;BINARY COUNT OF FILM CUTS THIS ORDER
SORTER:  DS    1      ;BIT 7 HI IF SORTER CONNECTED
MDATA:   DS    1      ;BIT 7 HI MANAGEMENT DATA
PCSEND:               ;PAPER CUTTER DEFINE STORAGE END
         END
```

ERRORS

What is claimed is:

1. In a photographic print cutting and sorting system in which individual photographic prints are cut from a strip of photographic paper and sorted into good, remake and reject prints as a function of remake and reject indicia associated with the remake and reject prints, respectively, a management data system comprising:

first storage means for storing a first good print count, a first remake print count, a first reject print count, a first total print count, a first good order count, a first remake order count, a first reject order count, and a first total order count;

digital processor means for incrementing the first good print count for each print cut which has neither remake nor reject indicia associated therewith, incrementing the first remake print count for each remake print indicated by the remake indica, incrementing the first reject print count for each reject print indicated by the reject indicia, incrementing the first total print count for each print cut, incrementing the first good order count for each order completed which contains only good prints, incrementing the first remake order count for each order completed which contains at least one remake print, incrementing the first reject order count for each order completed which contains at least one reject print, and incrementing the first total order count for each order completed; and data retrieval means for retrieving data which is a function of the first counts.

2. The management data system of claim 1 wherein the first storage means stores the first counts for each of a plurality of printers which produce the prints on the strip of photographic paper, and wherein the digital processor means increments the first counts associated with the printer which produced the prints on the strip of photographic print paper being cut and sorted.

3. The management data system of claim 2 wherein the data retrieval means comprises:

display means for displaying management data in response to signals from the digital processor; and data select means for causing the digital processor means to provide signals to the display means to display data based upon the first counts.

4. The management data system of claim 1 wherein the display and the data select means comprise a portable management data retrieval device adapted to be connected to the digital processor means when retrieval of data based upon the counts is desired.

5. The management data system of claim 1 and further comprising:

second storage means for storing a second good print count, a second remake print count, a second reject print count, a second total print count, a second good order count, a second remake order count, a second reject order count, and a second total order count; and wherein the digital processor means increments both the first and second counts.

6. The management data system of claim 5 and further comprising reset means for independently resetting the first counts and the second counts to permit the first and second counts to represent counts accumulated over different periods of time.

7. The management data system of claim 1 wherein the first storage means also stores, for each human operator who operates the print cutting and sorting system, a first total print cut count, a first total orders processed count and a first hours operated count.

8. The management data system of claim 1 wherein the data which is a function of the first counts includes ratios of the first good order count, the first remake order count, and the first reject order count to the first total order count.

9. The management data system of claims 1 or 8 wherein the data which is a function of the first counts includes ratios of the first good print count, the first remake print count, and the first reject print count to the first total print count.

10. In a photographic print cutting and sorting system in which individual photographic prints are cut from a strip of photograhic paper and sorted into good, remake, and reject prints, a management data system comprising:

first storage means for storing, for each of a plurality of photographic printers, a first good print count, a first remake print count, a first reject print count, and a first total print count; and storing, for each of a plurality of human operators who operate the print cutting and sorting system, a first total print cut count, a first total orders processed count, and a first hours operated count;

second storage means for storing, for each of the plurality of printers, a second good print count, a second remake print count, a second reject print count, and a second total print count; and storing, for each of the plurality of human operators, a second total print cut count, a second total orders processed count, and a second hours operated count;

printer designating means for designating one of the plurality of printers;

operator designating means for designating one of the plurality of human operators;

digital processor means for incrementing counts stored in the first and second storage means for the designated printer and the designated operator, the digital processor means incrementing the first and second good print count for each good print, incrementing the first and second remake print counts for each remake print, incrementing the first and second reject print counts for each reject print, incrementing the first and second total print counts for each print, incrementing the first and second total print cut counts for each print, incrementing the first and second total orders processed counts for each order completed, and incrementing the first and second hours operated counts for each incremental time period that the system is operated;

reset means for selectively resetting all of the first or second counts to permit the first and second counts to contain totals of the same items over different time periods; and data retrieval means for retrieving data which is a function of the first or second counts.

11. The management data system of claim 10 wherein the data retrieval means comprises:

display means for displaying management data in response to signals from the digital processor means; and data select means for causing the digital processor means to provide signals to the display means to display data which is a function of the first or second counts.

12. The management data system of claim 11 wherein the data retrieval means comprises a portable management data retrieval device adapted to be connected to the digital processor means when retrieval of the data which is a function of the first and second counts is desired.

13. The management data system of claim 12 wherein the reset means is also contained in the portable management data retrieval device.

14. The management data system of claim 10 wherein the first storage means also stores, for each of a plurality of photographic printers, a first good order count, a first remake order count, a first reject order count, and a first total order count; and wherein the second storage means also stores, for each of the plurality of photographic printers, a second good order count, a second remake order count, a second reject order count, and a second total order count; and wherein the digital processor means increments the first and second good order counts for each order completed which contains only good prints, increments the first and second remake order counts for each order completed which contains at least one remake print, increments the first and second reject order counts for each order which contains at least one reject print, and increments the first and second total order counts for each order completed.

15. In a photographic print cutting and sorting system in which individual photographic prints are cut from strips of photographic paper and sorted into good, remake and reject prints, a management data system comprising:

storage means for storing each of a plurality of photographic printers and for the combination of all printers, a first good print count, a first remake print count, a first reject print count, and a first total print count; and for storing, for each of a plurality of human operators of the print cutting and sorting system and for the combination of all of the operators, independently of the counts for each of the plurality of photographic prints, a first total prints cut count, a first total orders processed count, and a first hours operated count;

printer designating means for designating one of the plurality of printers;

operator designating means for designating one of the plurality of human operators;

digital processor means for incrementing the counts stored in the storage means for the designated printer and the designated operator, and for the combined printers and the combined operators; and data retrieval means for retrieving data which is a function of the first counts.

16. For use with photographic print cutting and sorting apparatus in wich individual photographic prints are cut from a strip of photographic paper and sorted into good, remake and reject prints, a management data system comprising:

storage means associated with the print cutting and sorting apparatus for storing counts indicative of good, remake, reject and total prints cut and good, remake, reject and total orders completed;

digital processor means associated with the print cutting and sorting systems for incrementing the counts as a function of prints cut and orders completed;

a portable management data retrieval device separate from the photographic print cutting and sorting apparatus and adapted to be connected to the digital processor means associated with the print cutting and sorting apparatus when retrieval of data based upon the counts is desired, the portable management data retrieval device including display means for displaying management data based upon the counts in response to signals from the digital processor means, and data select means for causing the digital processor means to provide signals to the display means and display data which are a function of the counts; and interconnection means for interconnecting the portable management data retrieval device and the digital processor means.

17. The management data system of claim 16 wherein the data select means comprises a keyboard which is addressed by the digital processor means when the portable management data retrieval device is connected to the digital processor means.

* * * * *